US009864317B2

(12) United States Patent
Uehara

(10) Patent No.: US 9,864,317 B2
(45) Date of Patent: Jan. 9, 2018

(54) IMAGE FORMING APPARATUS THAT STABLY GUIDES SHEET TO TRANSFER NIP PORTION

(71) Applicant: Kyocera Document Solutions Inc., Osaka (JP)

(72) Inventor: Masakazu Uehara, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/133,252

(22) Filed: Apr. 20, 2016

(65) Prior Publication Data

US 2016/0306315 A1 Oct. 20, 2016

(30) Foreign Application Priority Data

Apr. 20, 2015 (JP) ..... 2015-085555

(51) Int. Cl.
*G03G 15/00* (2006.01)

(52) U.S. Cl.
CPC ..... *G03G 15/6561* (2013.01)

(58) Field of Classification Search
CPC .... G03G 15/00; G03G 15/02; G03G 15/0266; G03G 15/0283; G03G 2215/00367; G03G 2215/00409; G03G 2215/00371
See application file for complete search history.

(56) References Cited

U.S. PATENT DOCUMENTS 4,338,017 A * 7/1982 Nishikawa ..... G03G 15/1675 399/145
5,909,605 A * 6/1999 Nishizawa ..... G03G 15/1675 399/66
8,477,162 B1 * 7/2013 Martell ..... B41J 2/32 347/171
2002/0064405 A1 * 5/2002 Tomiki ..... G03G 15/6558 399/316
2002/0181963 A1 * 12/2002 Takeda ..... B41J 11/009 399/45
2004/0250716 A1 * 12/2004 Onodera ..... B41L 13/04 101/116

(Continued)

FOREIGN PATENT DOCUMENTS

JP H02-025881 A 1/1990
JP H06-161187 A 6/1994

(Continued)

*Primary Examiner* — David Banh
(74) *Attorney, Agent, or Firm* — James Judge

(57) ABSTRACT

An image forming apparatus includes a housing, a registration roller pair, a first guiding portion, a second guiding portion, a resistor, and a grounding conductive mechanism. The housing is made of metal and has a grounded inner wall. The registration roller pair is located between the paper sheet feeder and the transfer member in the sheet conveyance path, includes a metallic registration roller and a facing roller that is constituted of an elastic material, and rotates in abutting contact with the registration roller, so as to convey the sheet toward the transfer nip portion. The first guiding portion is made of metal. The second guiding portion is made of a conductive resin material. The grounding conductive mechanism electrically conducts the registration roller, the first guiding portion, and the second guiding portion to the inner wall via a resistor.

5 Claims, 23 Drawing Sheets

(56) References Cited

U.S. PATENT DOCUMENTS

| | | | | |
|---|---|---|---|---|
| 2007/0045943 | A1 | 3/2007 | Shibayama | |
| 2007/0253755 | A1 | 11/2007 | Inui et al. | |
| 2009/0129831 | A1* | 5/2009 | Sakashita | G03G 15/657 399/309 |
| 2009/0285599 | A1* | 11/2009 | Isokawa | G03G 15/6532 399/111 |
| 2012/0230746 | A1* | 9/2012 | Namisaki | G03G 15/2085 399/400 |
| 2013/0241141 | A1* | 9/2013 | Karikusa | B65H 9/00 271/227 |
| 2014/0064761 | A1* | 3/2014 | Hayashi | G03G 15/1675 399/66 |
| 2015/0216036 | A1* | 7/2015 | Serizawa | G03G 15/50 399/88 |

FOREIGN PATENT DOCUMENTS

| | | | |
|---|---|---|---|
| JP | 2001-225981 | A | 8/2001 |
| JP | 2007-264208 | A | 10/2007 |
| JP | 2007-297218 | A | 11/2007 |

* cited by examiner

IMAGE FORMING APPARATUS THAT STABLY GUIDES SHEET TO TRANSFER NIP PORTION

INCORPORATION BY REFERENCE

This application is based upon, and claims the benefit of priority from, corresponding Japanese Patent Application No. 2015-085555 filed in the Japan Patent Office on Apr. 20, 2015, the entire contents of which are incorporated herein by reference.

BACKGROUND

Unless otherwise indicated herein, the description in this section is not prior art to the claims in this application and is not admitted to be prior art by inclusion in this section.

Among typical image forming apparatuses that form images on sheets, image forming apparatuses that include an image carrier, an exposing unit, a developing unit, a transfer unit, and a fixing unit are known. The exposing unit forms an electrostatic latent image on the image carrier, and the developing unit visualizes the electrostatic latent image as a toner image. The transfer unit then transfers the toner image on the image carrier onto a sheet. The sheet onto which the toner image is transferred is discharged after undergoing a fixing process by the fixing unit.

Registration roller pairs for conveying sheets toward a transfer nip area formed between the image carrier and the transfer unit have been disclosed. Also disclosed have been guide members, made of a synthetic resin polymer, for guiding sheets frontward and rearward of a registration roller pair. Furthermore, a technique whereby a sheet-guiding guide member is electrically grounded has been disclosed.

SUMMARY

An image forming apparatus according to one aspect of the disclosure includes a housing, a paper sheet feeder, a sheet conveyance path, an image carrier, a transfer member, a registration roller pair, a first guiding portion, a second guiding portion, a resistor, and a grounding conductive mechanism. The housing is made of metal and having a grounded inner wall. The paper sheet feeder feeds a sheet. The sheet conveyance path conveys the sheet fed from the paper sheet feeder to a predetermined conveyance direction. The image carrier carries a developer image on a surface of the image carrier. The transfer member is located facing the image carrier. The transfer member forms a transfer nip portion through which the sheet passes between the image carrier and the transfer member, so as to transfer the developer image onto the sheet. The registration roller pair is located between the paper sheet feeder and the transfer member in the sheet conveyance path. The registration roller pair includes a metallic registration roller and a facing roller, constituted of an elastic material, rotating in abutting contact with the registration roller. The registration roller pair conveys the sheet toward the transfer nip portion. The first guiding portion is located in an upstream side or downstream side in the conveyance direction of the registration roller pair in the sheet conveyance path. The first guiding portion is made of metal and guiding the sheet. The second guiding portion is made of a conductive resin material. The second guiding portion guides the sheet conveyed by the registration roller pair toward the transfer nip portion. The resistor has a predetermined electrical resistance. The grounding conductive mechanism electrically conducts the registration roller, the first guiding portion, and the second guiding portion to the inner wall via the resistor.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
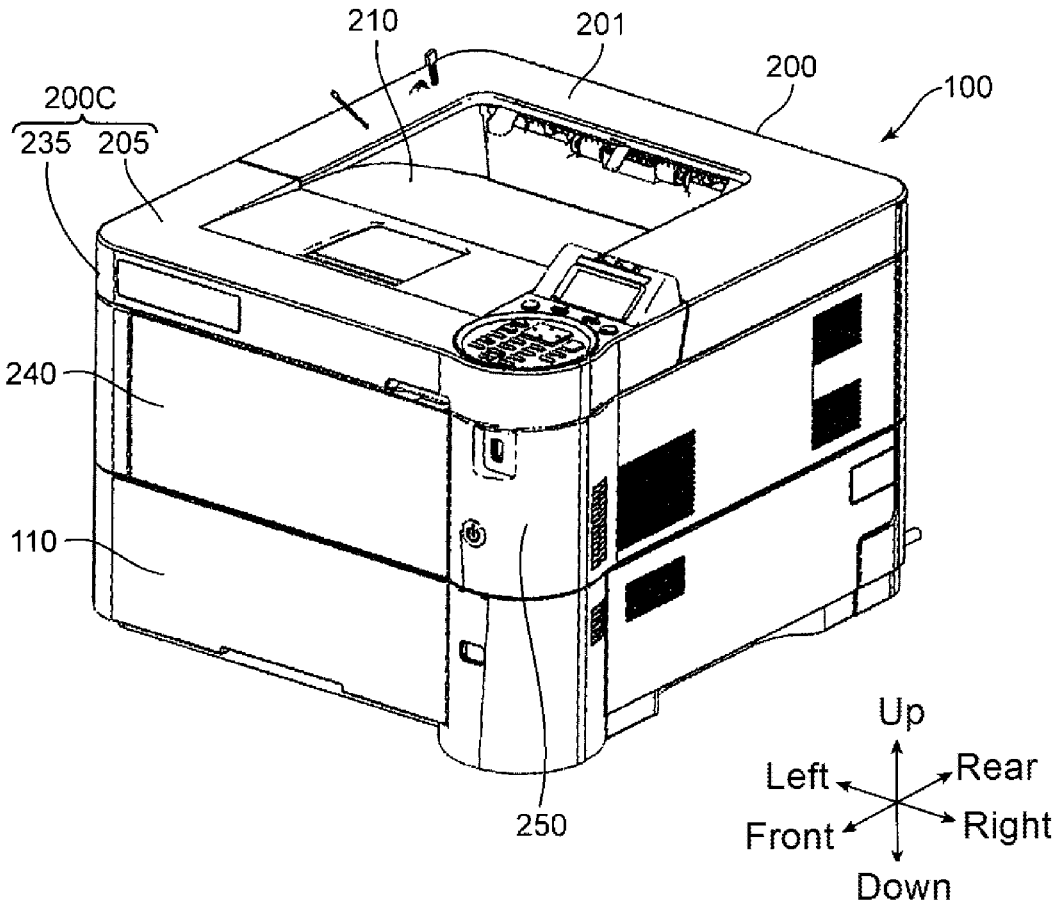
FIG. 1 obliquely illustrates a state where an opening/closing cover of an image forming apparatus according to one embodiment of the disclosure is closed.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
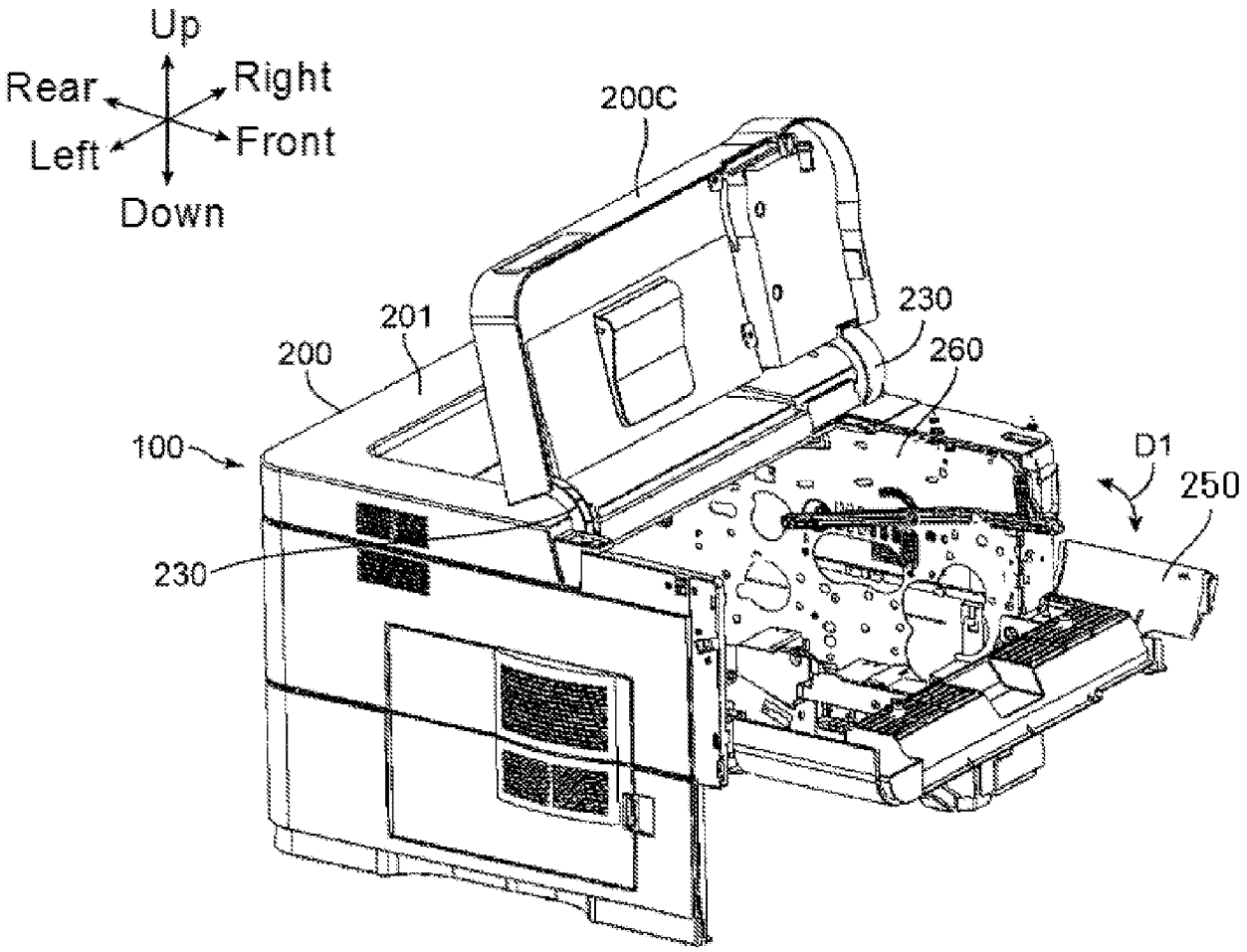
FIG. 2 obliquely illustrates a state where the opening/closing cover of the image forming apparatus according to the one embodiment is opened.
Figure 3:
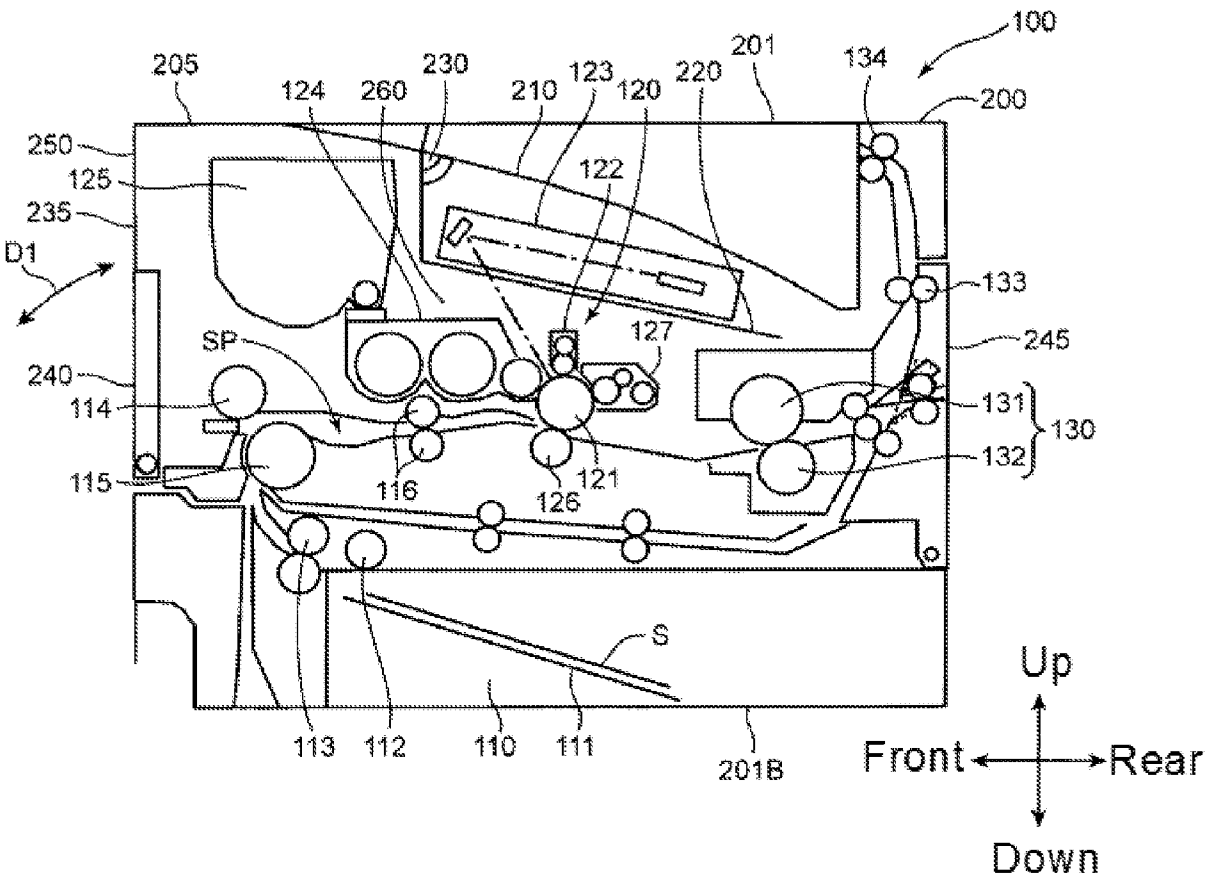
FIG. 3 schematically illustrates a cross-sectional view of an internal structure of the image forming apparatus according to the one embodiment.

The following describes one embodiment of the disclosure by referring to the accompanying drawings. FIG. 1 obliquely illustrates a printer 100 (an image forming apparatus) according to the one embodiment of the disclosure. FIG. 2 obliquely illustrates a state where an opening/closing cover 200C is opened upward, and a manual bypass tray 240 is opened downward in the printer 100. FIG. 2 illustrates the state where a cassette 110 and an image forming unit 120H, which will be described later, are extracted. FIG. 3 schematically illustrates a cross-sectional view of an internal structure of the printer 100 illustrated in FIGS. 1 and 2. While the printer 100 as the image forming apparatus illustrated in FIGS. 1 to 3 is, so-called, a black-and-white printer, the image forming apparatus may be a color printer, a facsimile device, a multi-functional peripheral that includes these functions, and other devices for forming a toner image on a sheet. In the following description, directional terms like "up," "down," "front," "rear," "left," and "right" are simply used for clarifying the description without limiting principles of the image forming apparatus.

The printer 100 includes a housing 200 that houses various units for forming an image on a sheet S. The housing 200 includes an upper wall 201 defining the top surface of the housing 200, a bottom wall 201B (FIG. 3) defining the bottom surface of the housing 200, a back side wall 245 (FIG. 3) between the upper wall 201 and the bottom wall 201B, and a front wall 250 located in front of the back side wall 245. The housing 200 includes a main-body internal space 260 where various kinds of units are located. The printer 100 includes the opening/closing cover 200C openably/closably mounted with respect to the housing 200.

The opening/closing cover 200C is constituted of a front-wall upper portion 235 that is an upper portion of the front wall 250 and an upper-wall front portion 205 that is a front portion of the upper wall 201. The opening/closing cover 200C is configured to be openable/closable in a vertical direction with a hinge shaft (not illustrated) that is located to a pair of arm portions 230, which is located at both the end portions in a lateral direction, as a fulcrum (FIG. 2). The open state of the opening/closing cover 200C opens the upper portion of the main-body internal space 260 to the outside.

A paper sheet discharge unit 210 is located in a center of the upper wall 201. The paper sheet discharge unit 210 includes an inclined surface inclining downward from the front portion to the rear portion of the upper wall 201. In the paper sheet discharge unit 210, the sheet S on which an image is formed in an image forming unit 120, which will be described later, is discharged. The manual bypass tray 240 is located in a center in the vertical direction of the front wall 250.

The front wall 250 is turnable in the vertical direction (an arrow D1 in FIGS. 2 and 3) with the lower end as a fulcrum. The open state of front wall 250 opens the front of the main-body internal space 260 to the outside. On the other hand, the close state of the front wall 250 closes the front of the main-body internal space 260. That is, the open state of both of the opening/closing cover 200C and the manual bypass tray 240 exposes the front and the upper portion of the main-body internal space 260 to the outside, as illustrated in FIG. 2.

With reference to FIG. 3, the printer 100 includes the cassette 110, a pickup roller 112, a first feed roller 113 (paper sheet feeder), a second feed roller 114, a conveyance roller 115, a registration roller pair 116, and the image forming unit 120.

The cassette 110 internally houses the sheet S. The cassette 110 includes a lift plate 111 that supports the sheet S. The lift plate 111 is inclined to push up the leading edge of the sheet S. The cassette 110 defines a part of the front surface of the housing 200, and is configured to be extractable forward with respect to the housing 200.

The pickup roller 112 is located on the leading edge of the sheet S, which is pushed up by the lift plate 111. Rotation of the pickup roller 112 sends out the sheet S from the cassette 110.

The first feed roller 113 is located in the downstream side of the pickup roller 112. The first feed roller 113 further sends out (feeds paper) the sheet S downstream. The second feed roller 114 is located inside (rear side) the fulcrum of the manual bypass tray 240. The second feed roller 114 pulls the sheet S on the manual bypass tray 240 inside the housing 200. A user selectably uses the sheet S housed in the cassette 110 or the sheet S placed on the manual bypass tray 240.

The conveyance roller 115 is located in the downstream side (hereinafter also simply referred to as a downstream side) in a sheet conveyance direction (hereinafter also simply referred to as a conveyance direction) of the first feed roller 113 and the second feed roller 114. The conveyance roller 115 further sends out the sheet S, which is sent out by the first feed roller 113 and the second feed roller 114, downstream.

The registration roller pair 116 has a function of correcting an skew conveyance of the sheet S. This adjusts a position of an image to be formed on the sheet S. The registration roller pair 116 conveys the sheet S toward a transfer nip portion TP of the image forming unit 120 in accordance with timing of the image formation by the image forming unit 120.

The image forming unit 120 includes a photoreceptor drum 121 (an image carrier), a charger 122, an exposure apparatus 123, a developing device 124, a toner container 125, a transfer roller 126 (a transfer member), and a cleaning apparatus 127. Of the image forming unit 120, the photoreceptor drum 121, the charger 122, the developing device 124, the toner container 125, and the cleaning apparatus 127 are constituted to be integrally removably attachable to the housing 200 as the image forming unit 120H, which will be described later.

The photoreceptor drum 121 has a cylindrical shape. The photoreceptor drum 121 forms an electrostatic latent image on its circumference surface and carries a toner image (a developer image) corresponding to this electrostatic latent image. The charger 122 applied with a predetermined voltage causes the circumference surface of the photoreceptor drum 121 to be approximately uniformly charged.

The exposure apparatus 123 irradiates the circumference surface of the photoreceptor drum 121 charged by the charger 122 with a laser beam. This laser beam is irradiated in accordance with image data output from an external device (not illustrated) such as a personal computer communicatively connected to the printer 100. This results in forming the electrostatic latent image corresponding to the image data on the circumference surface of the photoreceptor drum 121. The exposure apparatus 123 is secured on a mounting plate 220 constituting a part of the housing 200 (FIG. 3).

The developing device 124 supplies a toner to the circumference surface of the photoreceptor drum 121 on which the electrostatic latent image is formed. The toner container 125 supplies a toner to the developing device 124. Supplying the toner to the photoreceptor drum 121 by the developing device 124 develops (visualizes) the electrostatic latent image formed on the circumference surface of the photoreceptor drum 121. This results in forming a toner image on the circumference surface of the photoreceptor drum 121.

The transfer roller 126 is rotatably located so as to face the circumference surface of the photoreceptor drum 121. When the sheet S conveyed from the registration roller pair 116 passes through the transfer nip portion TP (FIG. 4) between the photoreceptor drum 121 and the transfer roller 126, the transfer roller 126 transfers the toner image formed on the circumference surface of the photoreceptor drum 121 to the sheet S.

The cleaning apparatus 127 removes the toner remaining on the circumference surface of the photoreceptor drum 121 after the toner image has been transferred on the sheet S. The circumference surface of the photoreceptor drum 121, which has been cleaned by the cleaning apparatus 127, passes through under the charger 122 again and is uniformly charged. Subsequently, formation of a toner image described above is additionally performed.

The printer 100 further includes a fixing unit 130 that fixes the toner image on the sheet S in the downstream side of the conveyance direction with respect to the image forming unit 120. The fixing unit 130 includes a heating roller 131 that melts the toner on the sheet S and a pressure roller 132 that causes the sheet S to be brought into close contact with the heating roller 131. After the sheet S passes through between the heating roller 131 and the pressure roller 132, the toner image fixes on the sheet S.

The printer 100 further includes a conveyance roller pair 133 located in the downstream side of the fixing unit 130 and a discharge roller pair 134 located in the downstream side of the conveyance roller pair 133. The sheet S is conveyed upward by the conveyance roller pair 133 and is finally discharged out of the housing 200 by the discharge roller pair 134. The sheet S discharged out of the housing 200 is stacked on the paper sheet discharge unit 210. The printer 100 includes a sheet conveyance path SP that runs inside the housing 200 (FIG. 3). The sheet conveyance path SP runs to pass through the registration roller pair 116 and the transfer nip portion TP from the cassette 110, and conveys the sheet S toward a predetermined conveyance direction.

Figure 4:
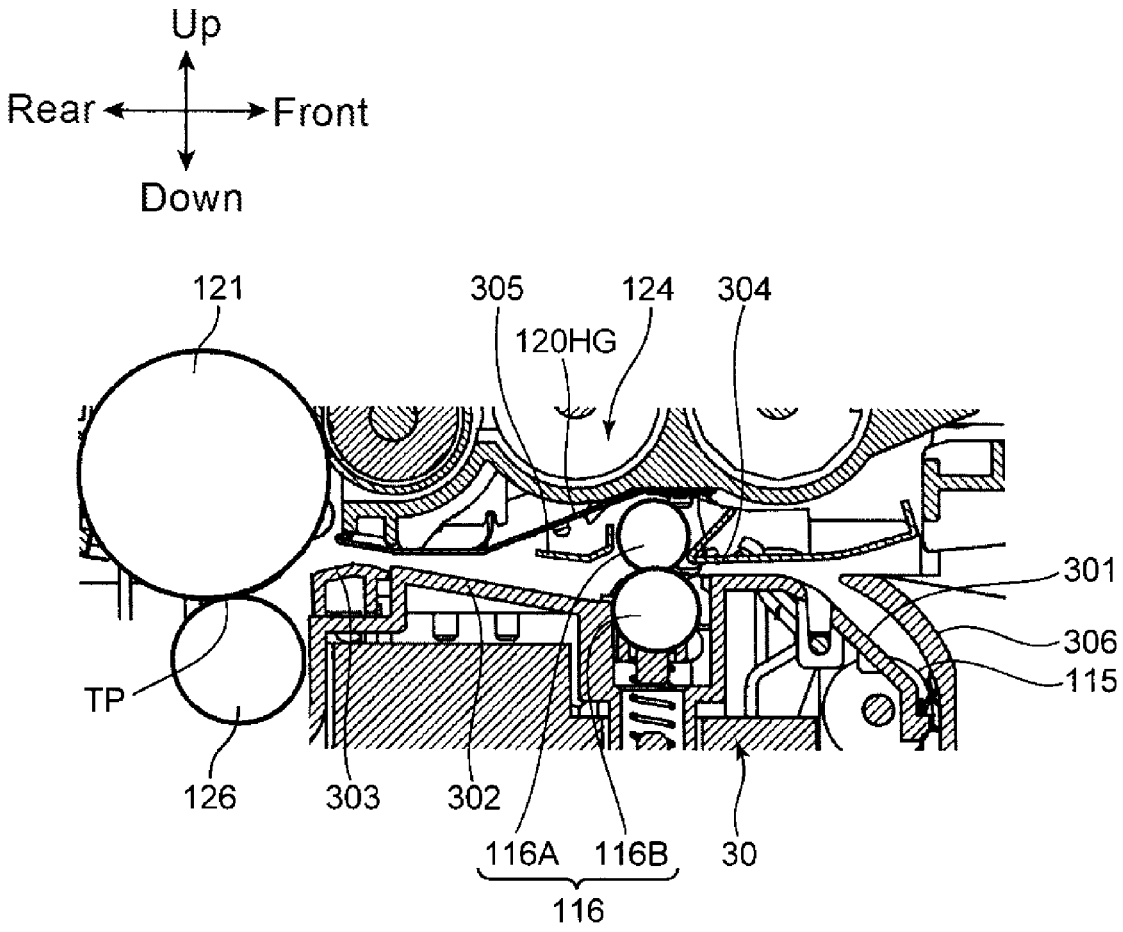
FIG. 4 illustrates an enlarged cross-sectional view of a periphery of a registration roller pair and a transfer nip portion in the image forming apparatus according to the one embodiment.
Figure 5A:
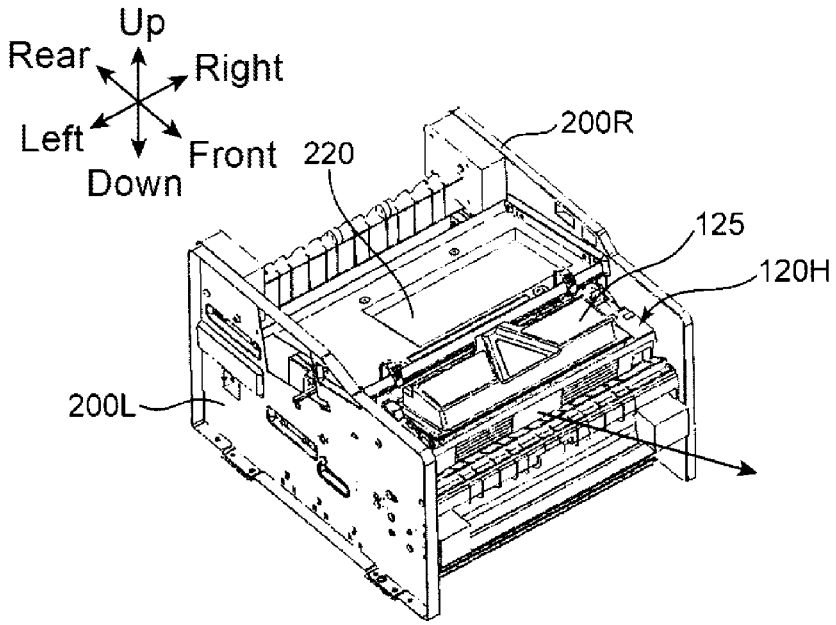
FIG. 5A obliquely illustrates a state where an image forming unit is mounted in the inside of the image forming apparatus according to the one embodiment.
Figure 5B:
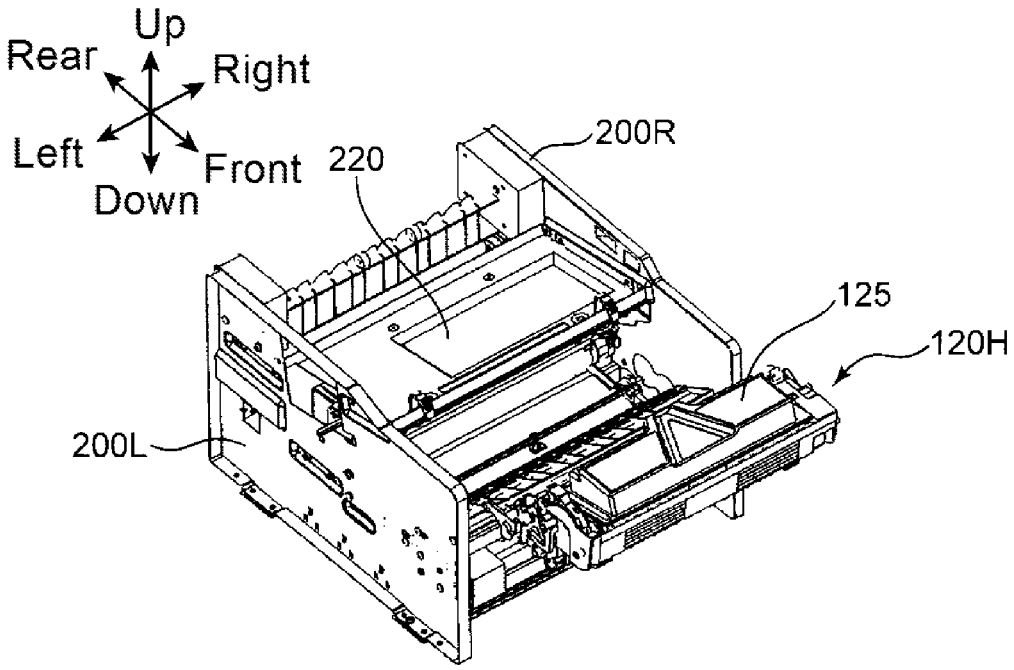
FIG. 5B obliquely illustrates a state where the image forming unit is detached from the inside of the image forming apparatus according to the one embodiment.
Figure 6A:
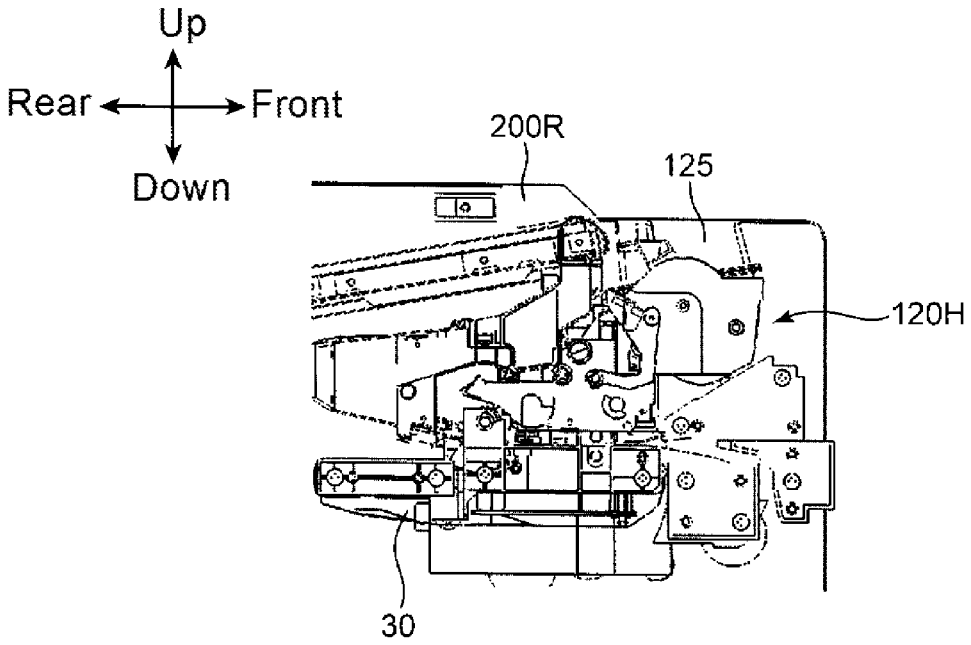
FIG. 6A illustrates a cross-sectional view of a state where the image forming unit is mounted in the inside of the image forming apparatus according to the one embodiment.
Figure 6B:
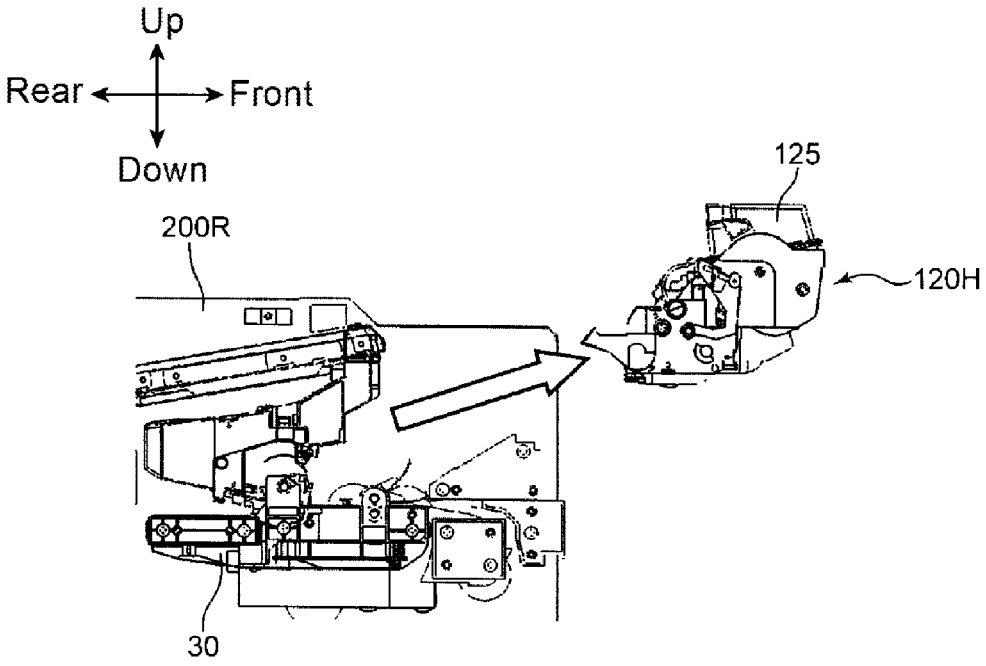
FIG. 6B illustrates a cross-sectional view of a state where the image forming unit is detached from the inside of the image forming apparatus according to the one embodiment.

FIG. 4 illustrates an enlarged cross-sectional view of a periphery of the registration roller pair 116 and the transfer nip portion TP in the printer 100 according to the embodiment. FIG. 5A obliquely illustrates a state where the image forming unit 120H is mounted to the housing 200 in the inside of the printer 100 according to the embodiment. FIG. 5B obliquely illustrates a state where the image forming unit 120H is detached from the housing 200. Similarly, FIG. 6A illustrates a cross-sectional view of a state where the image forming unit 120H is mounted to the housing 200 in the inside of the printer 100 according to the embodiment. FIG. 6B illustrates a cross-sectional view of a state where the image forming unit 120H is detached from the housing 200.

With reference to FIGS. 5A to 6B, the printer 100 includes a right side frame 200R, a left side frame 200L, and the image forming unit 120H. The right side frame 200R and the left side frame 200L are metallic frames constituting a part of the housing 200. The right side frame 200R and the left side frame 200L are wall portions located upright in the vertical direction, respectively, at the left and right end portions of the housing 200. The above-described mounting plate 220 is supported by the left side frame 200L and the right side frame 200R (see FIG. 5A). The image forming unit 120H is a unit that constitutes the image forming unit 120 and is removable with respect to the housing 200. Especially, the image forming unit 120H rotatably supports the photoreceptor drum 121. In addition to the photoreceptor drum 121, the image forming unit 120H integrally supports the charger 122, the developing device 124, the toner container 125, and the cleaning apparatus 127. As illustrated in FIG. 2, when, in the printer 100, the opening/closing cover 200C is opened upward and the front wall 250 is opened downward, the image forming unit 120H is configured to be removably attachable to the housing 200. When the image forming unit 120H is mounted to the housing 200, the developing device 124, the photoreceptor drum 121, and the cleaning apparatus 127 are located under the mounting plate 220 (exposure apparatus 123) (FIG. 3). The image forming unit 120H includes a bottom surface portion 120HG (FIG. 4). The bottom surface portion 120HG is positioned in the bottom surface of the developing device 124 of the image forming unit 120H. The bottom surface portion 120HG is made of a sheet metal and is grounded.

With reference to FIGS. 4, 6A and 6B, the printer 100 includes a conveyance unit 30. The conveyance unit 30 is a unit secured to the housing 200 under the image forming unit 120H. In addition to the above-described conveyance roller 115 and registration roller pair 116, the conveyance unit 30 includes an upstream-side lower guide 301, a downstream-side lower guide 302, a pre-transfer guide 303 (a second guiding portion), a pre-registration sheet metal 304 (a first guiding portion, an upstream-side guiding member), and a post-registration sheet metal 305 (the first guiding portion, a downstream-side guiding member) (FIG. 4).

The registration roller pair 116 is located between the first feed roller 113 and the transfer roller 126, in the sheet conveyance path SP. The registration roller pair 116 includes a registration roller 116A and a registration-roller facing roller 116B. The registration roller 116A is a metallic roller. The registration-roller facing roller 116B is made of an elastic material and is a roller that rotates in abutting contact with the registration roller 116A.

The upstream-side lower guide 301 is a guiding member located in the upstream side in the conveyance direction of the registration roller pair 116, in the sheet conveyance path SP. In the upstream-side end portion in the conveyance direction of the upstream-side lower guide 301, the above-described conveyance roller 115 is rotatably supported (see FIGS. 4 and 8A). The upstream-side lower guide 301 defines the lower portion of the sheet conveyance path SP.

The downstream-side lower guide 302 is a guiding member located in the downstream side in the conveyance direction of the registration roller pair 116, in the sheet conveyance path SP. The downstream-side lower guide 302 defines the lower portion of the sheet conveyance path SP. As illustrated in FIG. 4, the downstream-side lower guide 302 has an inclined surface formed rising toward the conveyance direction (rear direction) of the sheet S.

The pre-transfer guide 303 is connected to the downstream side in the conveyance direction of the downstream-side lower guide 302. The pre-transfer guide 303 is made of a conductive resin material. In this embodiment, the pre-transfer guide 303 is made of PPE (polyphenylene ether)+PS (polystyrene). The pre-transfer guide 303 guides the sheet S conveyed by the registration roller pair 116 toward the transfer nip portion TP. When viewed with the cross section, which is perpendicular to the width direction of the sheet S, illustrated in FIG. 4, the pre-transfer guide 303 has an approximately rectangular shape and a bar-shaped member extending in the lateral direction (the direction perpendicular to the paper surface of FIG. 4).

The pre-registration sheet metal 304 is located over the upstream-side lower guide 301 and defines the top surface portion of the sheet conveyance path SP in the upstream side in the conveyance direction of the registration roller pair 116. Similarly, the post-registration sheet metal 305 is located over the downstream-side lower guide 302 and defines the top surface portion of the sheet conveyance path SP in the downstream side in the conveyance direction of the registration roller pair 116. The pre-registration sheet metal 304 and the post-registration sheet metal 305 are made of a metallic sheet metal member. As illustrated in FIG. 4, the pre-registration sheet metal 304 extends along the conveyance direction longer than the post-registration sheet metal 305. The pre-registration sheet metal 304 and the post-registration sheet metal 305 are members extending longer in the sheet width direction (the lateral direction) perpendicular to the conveyance direction of the sheet S.

The printer 100 further includes an upstream-side upper guide 306. As illustrated in FIG. 4, the upstream-side upper guide 306 is a guiding member located facing to the upstream-side lower guide 301. The upstream-side upper guide 306 defines the top surface portion of the sheet conveyance path SP in the upstream side in the conveyance direction with respect to the pre-registration sheet metal 304.

With reference to FIG. 4, the sheet conveyance path SP runs along the approximately horizontal direction from the upstream side in the conveyance direction up to the downstream side in the conveyance direction of the registration roller pair 116. The above-described bottom surface portion 120HG of the image forming unit 120H is located over the post-registration sheet metal 305 at intervals. Further, the bottom surface portion 120HG of the image forming unit 120H defines the top surface portion of the sheet conveyance path SP in the downstream side in the conveyance direction with respect to the post-registration sheet metal 305. The bottom surface portion 120HG guides the sheet S toward the transfer nip portion TP.

In this embodiment, the pre-registration sheet metal 304 and the post-registration sheet metal 305, which are located in the upstream side and the downstream side in the conveyance direction of the registration roller pair 116, are constituted of a sheet-metal member. This ensures decrease of the occupying space of the guiding member that guides the sheet S and ensures a guiding member having a high strength. In view of this, this ensures downsizing of the printer 100 compared to the case where all guiding members in the periphery of the registration roller pair 116 are constituted of resin material.

Rotation of the registration roller pair 116 conveys the sheet S, the distal end portion of which is once halted in the registration roller pair 116, toward the transfer nip portion TP. In this case, the distal end portion of the sheet S may be brought into strong contact with the post-registration sheet metal 305. Even in such a case, in this embodiment, the bottom surface portion 120HG of the image forming unit 120H is located over the post-registration sheet metal 305 at intervals. Consequently, the impact by the sheet S with respect to the post-registration sheet metal 305 is prevented from transmitting to the image forming unit 120H. As a result, this suppresses the occurrence of image defects (band, image shift) to the electrostatic latent image and the toner image formed on the photoreceptor drum 121 during conveyance of the sheet S. With reference to FIG. 4, after the distal end portion of the sheet S is guided in the downstream side in the conveyance direction by the post-registration sheet metal 305, the distal end portion of the sheet S is brought into contact with the bottom surface portion 120HG of the image forming unit 120H or the downstream-side lower guide 302 with a weak contact force.

Figure 7:
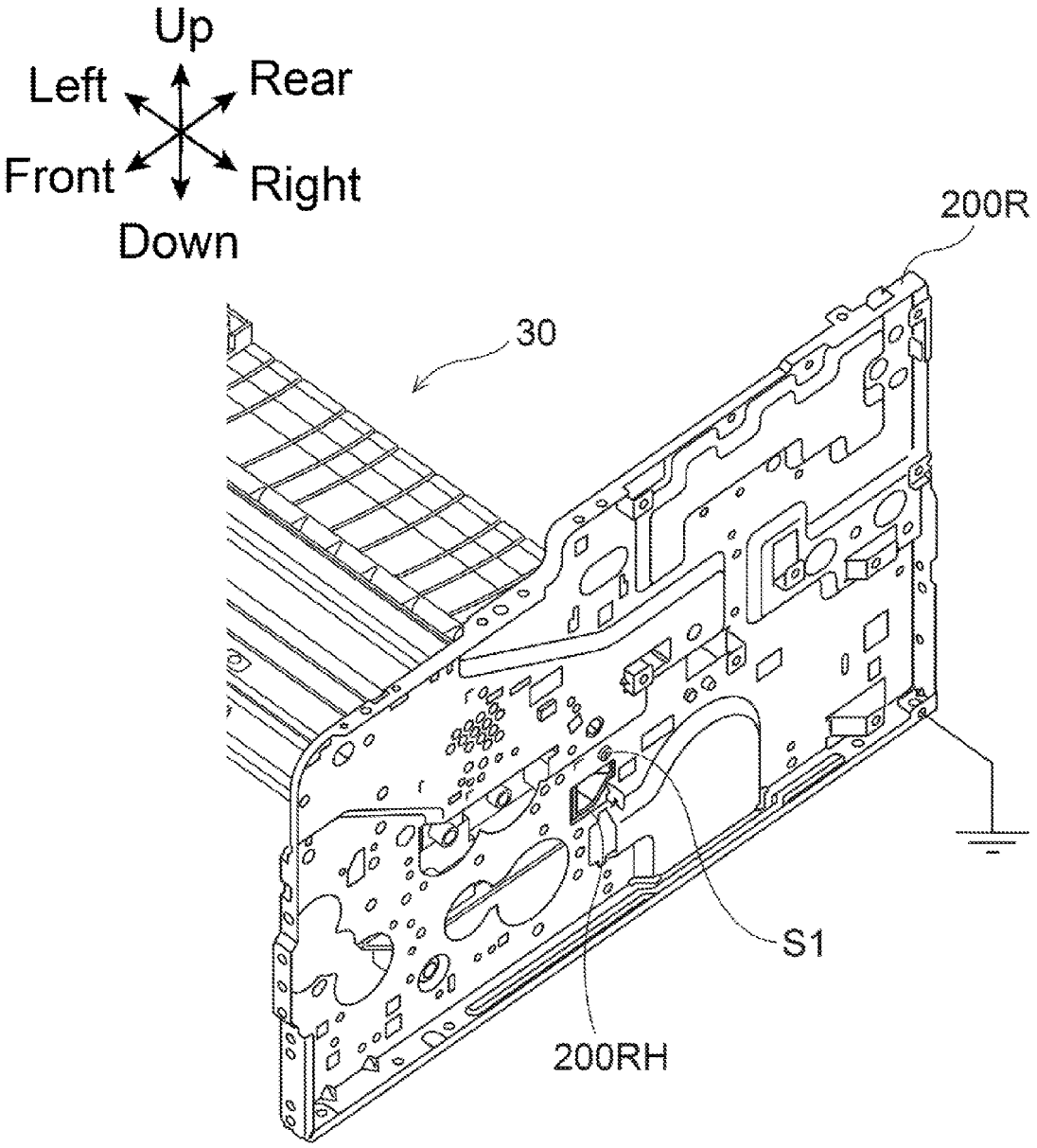
FIG. 7 obliquely illustrates an inner wall portion and a conveyance unit of the image forming apparatus according to the one embodiment.
Figure 8A:
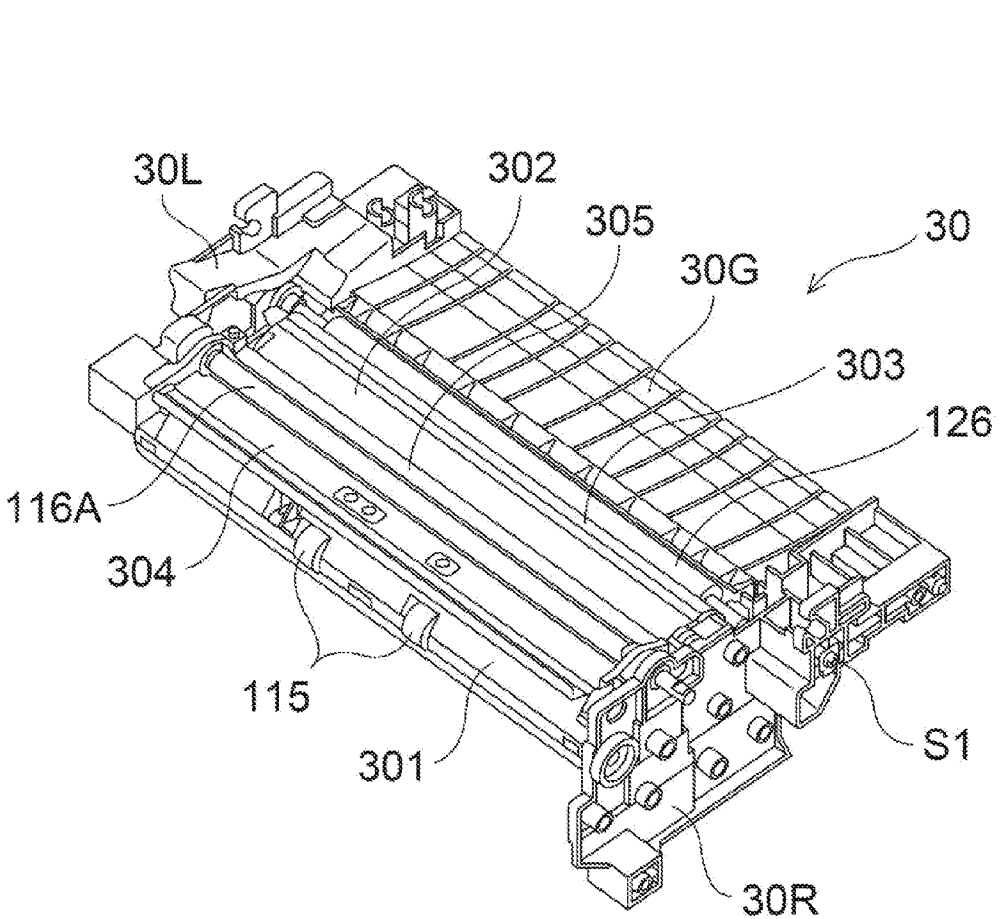
FIG. 8A obliquely illustrates the conveyance unit of the image forming apparatus according to the one embodiment.
Figure 8A:
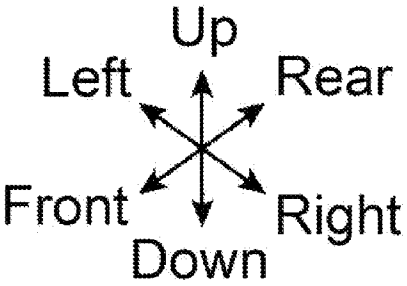
Figure 8B:
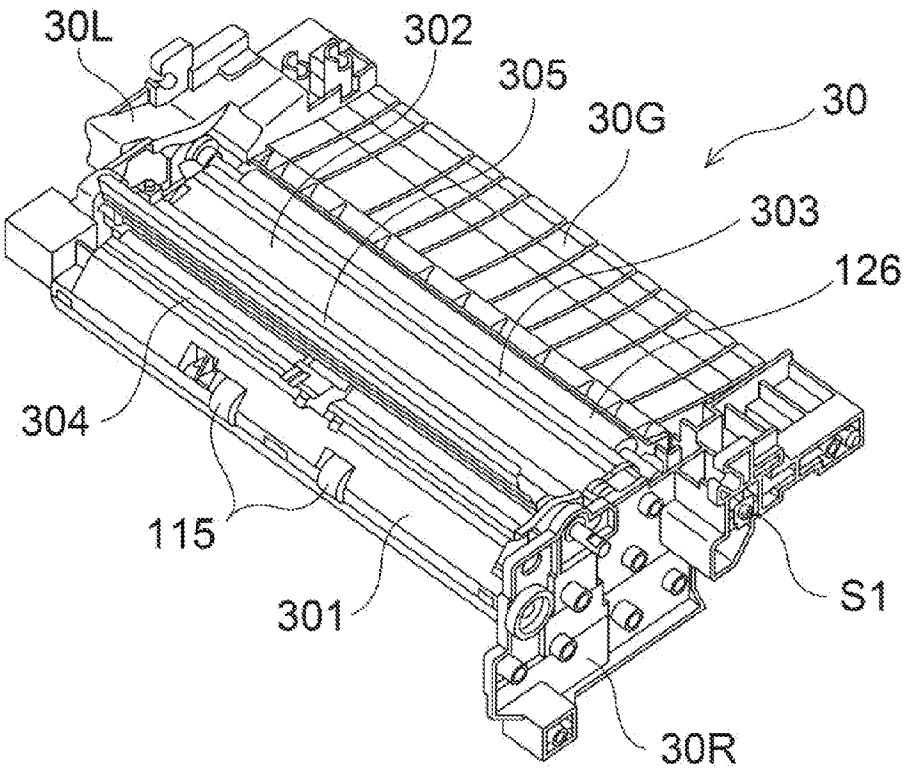
FIG. 8B obliquely illustrates the conveyance unit of the image forming apparatus according to the one embodiment.
Figure 8B:
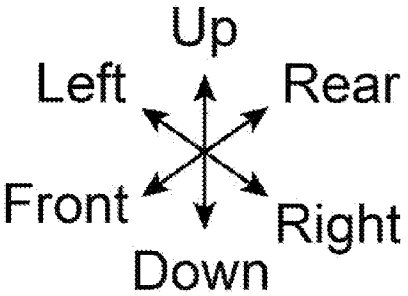
Figure 9A:
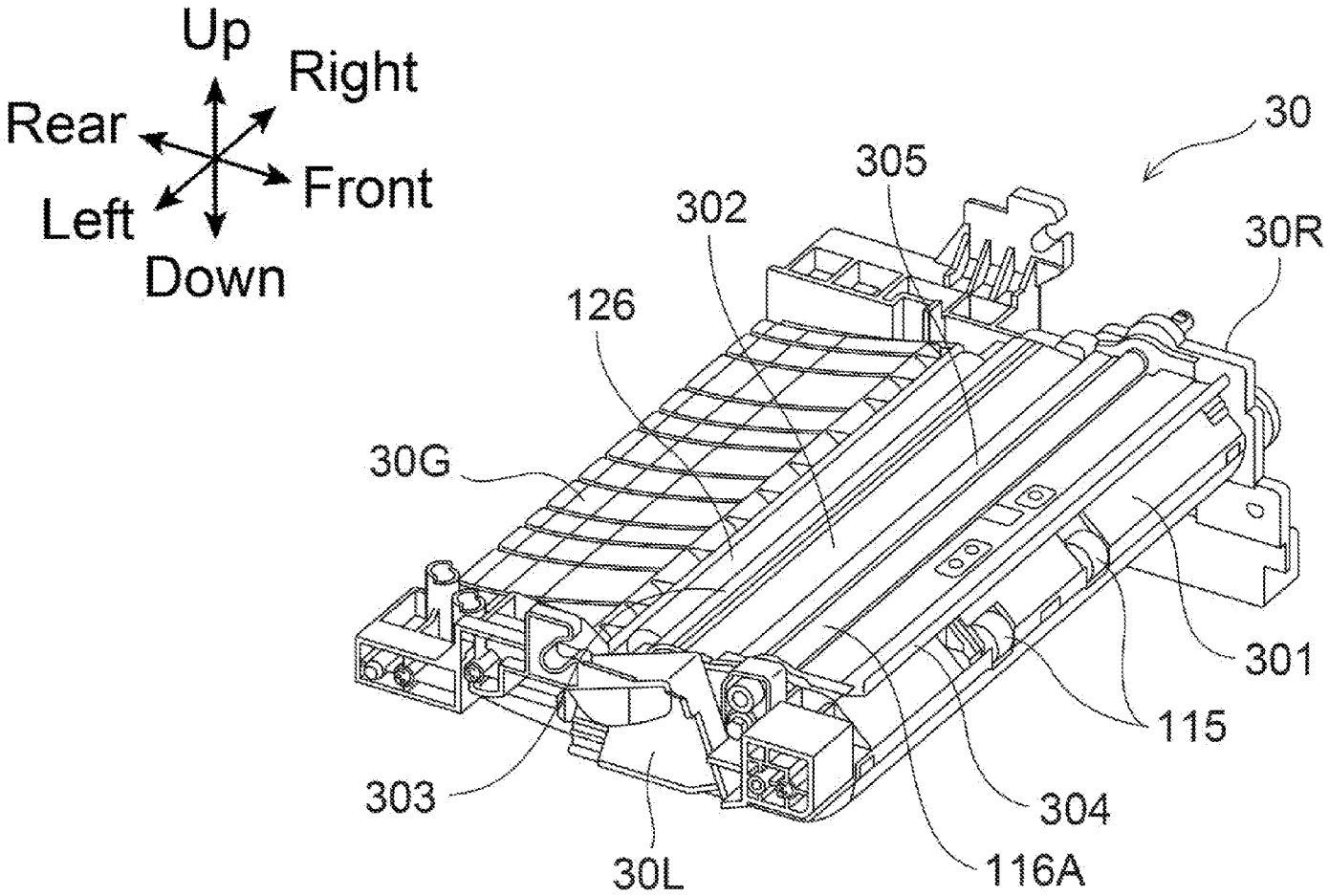
FIG. 9A obliquely illustrates the conveyance unit of the image forming apparatus according to the one embodiment.
Figure 9B:
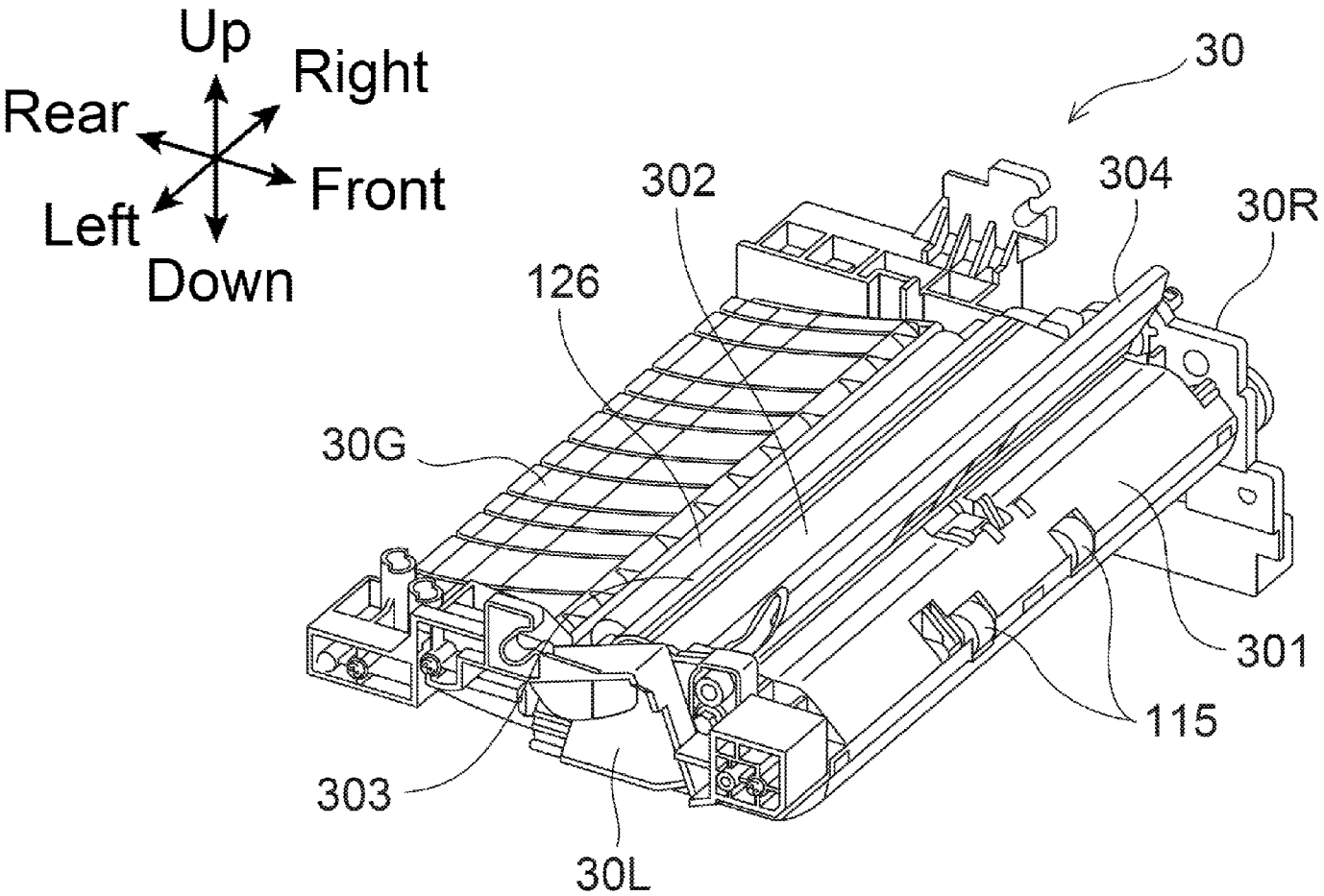
FIG. 9B obliquely illustrates the conveyance unit of the image forming apparatus according to the one embodiment.
Figure 10A:
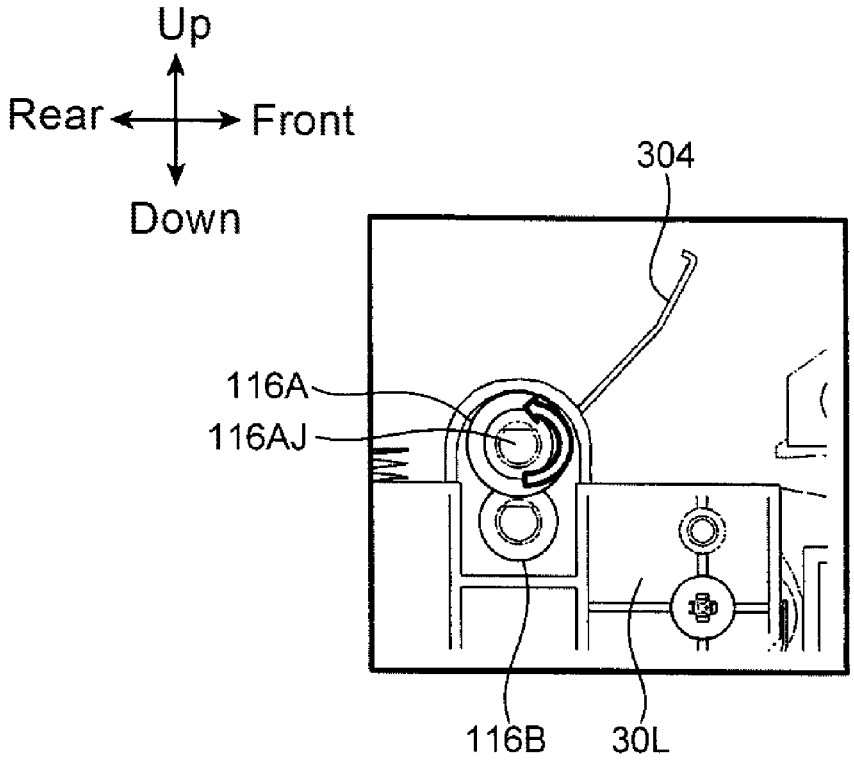
FIG. 10A illustrates a state where an upstream-side guiding member of the image forming apparatus according to the one embodiment rotates from the side surface.
Figure 10B:
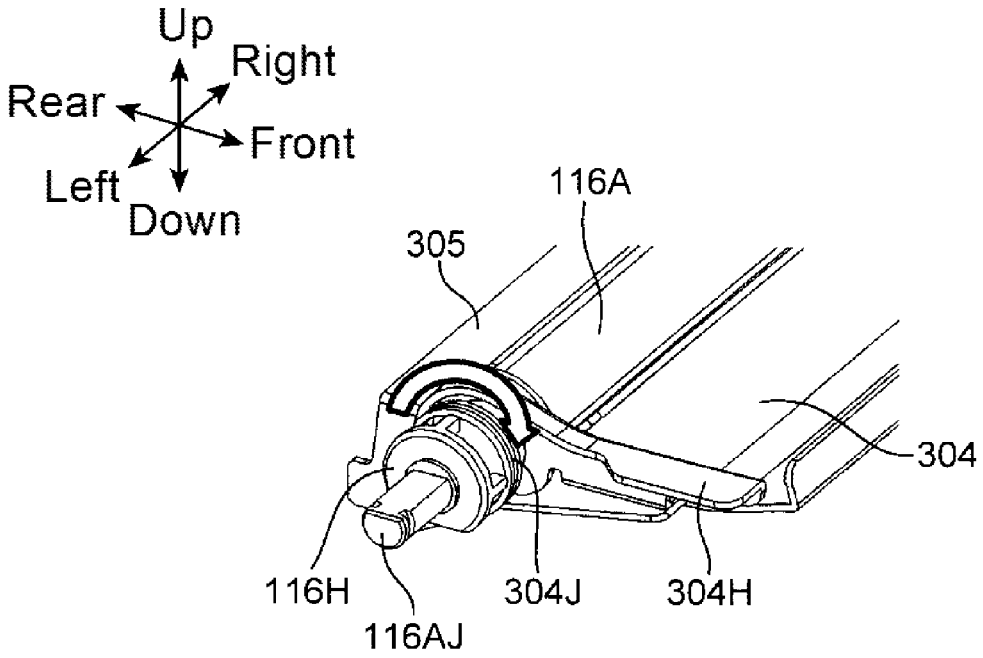
FIG. 10B obliquely illustrates a periphery of the registration roller of the image forming apparatus according to the one embodiment.

FIG. 7 obliquely illustrates the right side frame 200R and the conveyance unit 30 of the printer 100 according to the embodiment. FIGS. 8A and 8B obliquely illustrate the conveyance unit 30 of the image forming apparatus according to the one embodiment of the disclosure. FIGS. 9A and 9B obliquely illustrate the conveyance unit 30 according to the embodiment. FIG. 10A illustrates a state where the pre-registration sheet metal 304 of the conveyance unit 30 rotates from the side surface. FIG. 10B obliquely illustrates the enlarged view of the end-portion periphery of the registration roller 116A in the conveyance unit 30.

With reference to FIG. 7, the right side frame 200R is grounded. In this embodiment, some of the members of the printer 100 are held to a ground potential (0V) via the right side frame 200R. The above-described conveyance unit 30 is supported by the right side frame 200R and the left side frame 200L (FIG. 5A). A first screw S1 illustrated in FIG. 7 is a part of fastening screws for securing the conveyance unit 30 to the right side frame 200R. The right side frame 200R includes a frame opening 200RH. The frame opening 200RH is an opening that opens in the approximately center of the right side frame 200R.

As illustrated in FIGS. 8A to 9B, the above-described conveyance roller 115 exposes in the front end side of the conveyance unit 30. The upstream-side lower guide 301 is located in the front end side of the conveyance unit 30. Further, in the top surface portion of the conveyance unit 30, the pre-registration sheet metal 304, the registration roller 116A, the post-registration sheet metal 305, the downstream-side lower guide 302, the pre-transfer guide 303, and the transfer roller 126 are located, from the front to the rear. Further, the conveyance unit 30 includes a unit-right-side wall 30R, a unit-left-side wall 30L, and a post-transfer guide surface 30G.

The unit-right-side wall 30R and the unit-left-side wall 30L are sidewalls located in the left and right end portions of the conveyance unit 30. The post-transfer guide surface 30G is a guide surface located in the top surface portion of the conveyance unit 30, in the rear with respect to the transfer roller 126. The post-transfer guide surface 30G guides the sheet S, on which the toner image has been transferred in the transfer nip portion TP, to the fixing unit 130.

With reference to FIGS. 10A and 10B, the conveyance unit 30 further includes a registration-roller bearing portion 116H (a fulcrum, a third conduction portion), and a biasing spring 304J. The pre-registration sheet metal 304 includes a sheet-metal handle portion 304H. Further, the registration roller 116A includes a registration-roller shaft portion 116AJ.

The registration-roller bearing portion 116H is constituted of conductive POM (polyacetal) and is a pair of cylindrically-shaped bearing portions included at both the end portions in the axial direction (the lateral direction) of the registration roller pair 116. The registration-roller bearing portion 116H rotatably supports the registration roller pair 116. The registration-roller shaft portion 116AJ is inserted into the registration-roller bearing portion 116H. The biasing spring 304J is a torsion coil spring fit onto the outer peripheral portion of the registration-roller bearing portion 116H. The biasing spring 304J is engagingly locked to the sheet-metal handle portion 304H of the pre-registration sheet metal 304. As indicated by an arrow in FIG. 10B, the biasing spring 304J biases the pre-registration sheet metal 304 around the registration-roller shaft portion 116AJ such that the front end side of the pre-registration sheet metal 304 moves downward.

The sheet-metal handle portion 304H of the pre-registration sheet metal 304 is a sidewall provided in the left and right end portions of the pre-registration sheet metal 304. As illustrated in FIG. 10B, the upper end portion in the front end side of the sheet-metal handle portion 304H is bent toward the outside in the lateral direction. A user or a maintenance worker of the printer 100 can clasp this bent portion. The rear end side of the sheet-metal handle portion 304H has a U shape (not illustrated). The U-shaped portion fits onto the outer peripheral portion of the registration-roller bearing portion 116H. Consequently, the pre-registration sheet metal 304 can rotate with the registration-roller bearing portion 116H (registration-roller shaft portion 116AJ) as a fulcrum.

As illustrated in FIGS. 5B and 6B, detaching the image forming unit 120H from the housing 200 of the printer 100 enables visualization of the top surface portion of the conveyance unit 30 from the outside of the printer 100. A user of the printer 100 clasps the sheet-metal handle portion 304H of the pre-registration sheet metal 304 and rotates the front end side of the pre-registration sheet metal 304 upward (see an arrow in FIG. 10A, and FIGS. 8B and 9B) against the biasing force of the biasing spring 304J. This results in opening a part of the sheet conveyance path SP in the upstream side in the conveyance direction with respect to the registration roller pair 116. Consequently, even when the sheet S is stuck in the sheet conveyance path SP, the sheet S can be easily removed. Thus, in this embodiment, the pre-registration sheet metal 304 rotates around the registration-roller bearing portion 116H, which is located on the identical axis line with the registration-roller shaft portion 116AJ.

Figure 11:
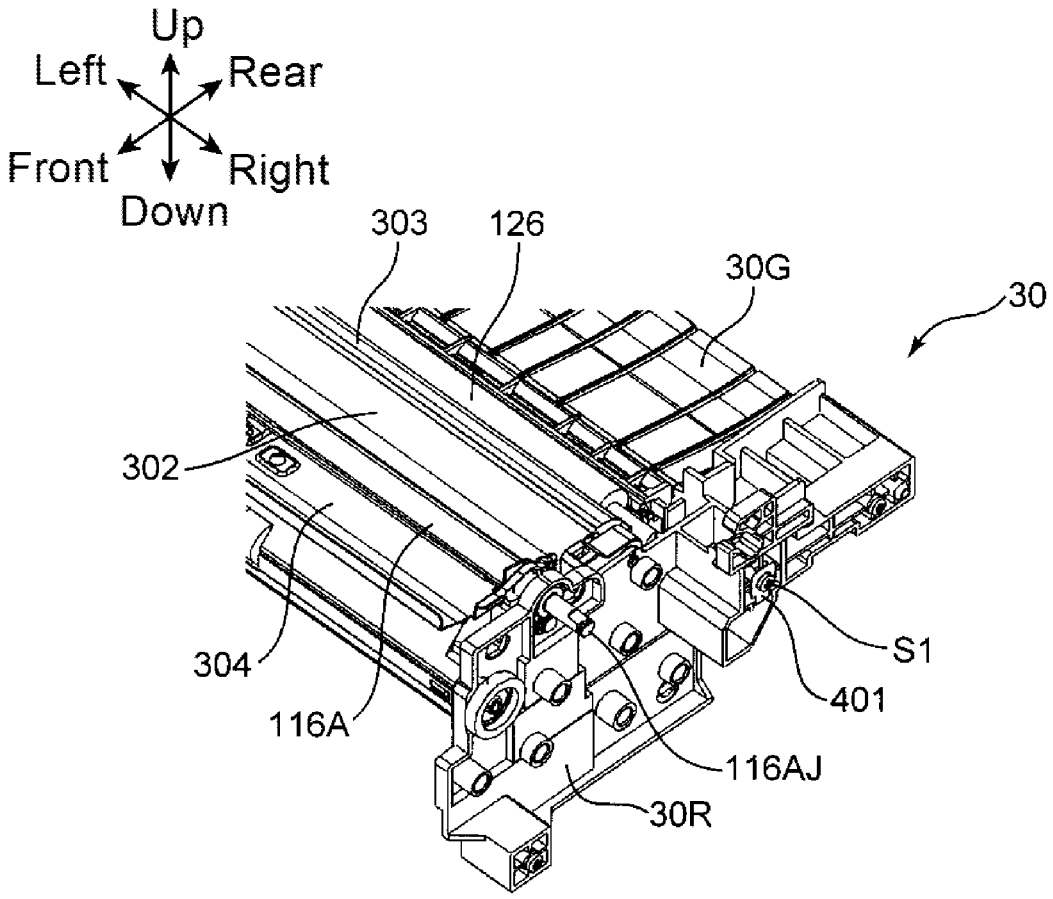
FIG. 11 obliquely illustrates a part of the conveyance unit of the image forming apparatus according to the one embodiment.
Figure 12A:
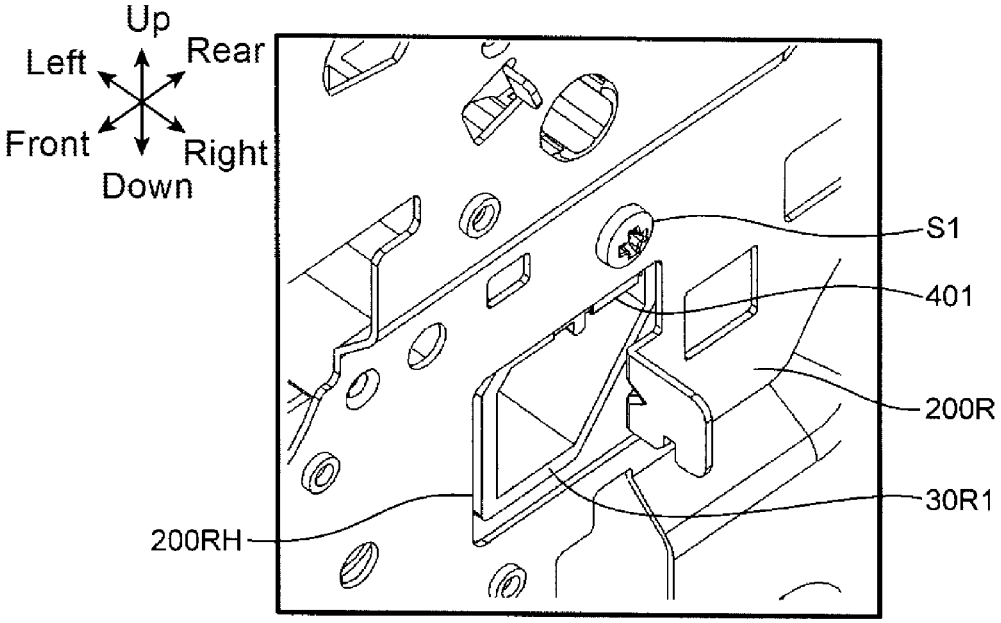
FIG. 12A obliquely illustrates an enlarged view of the inner wall and a part of the conveyance unit of the image forming apparatus according to the one embodiment.
Figure 12B:
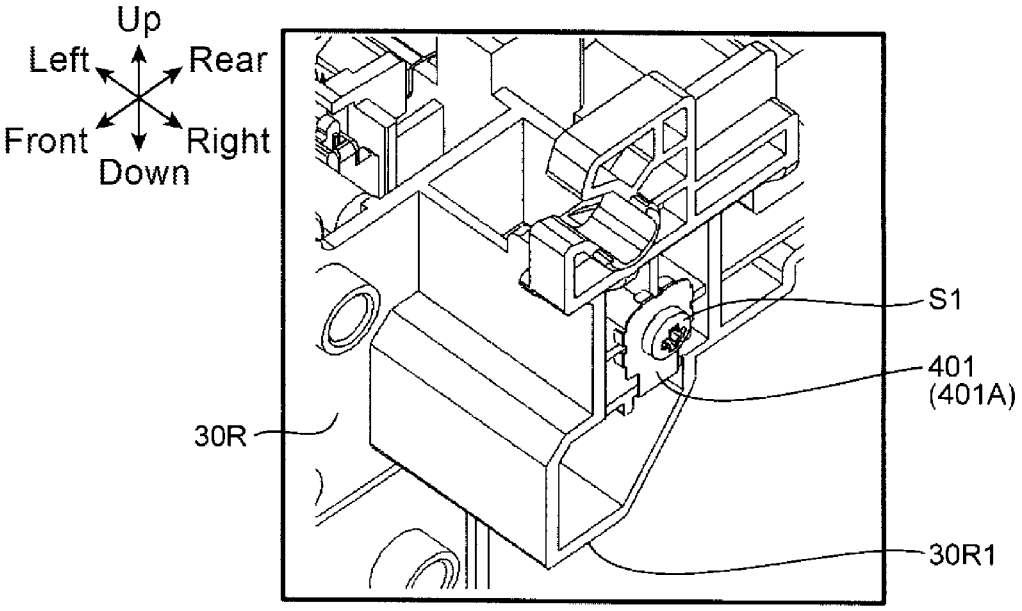
FIG. 12B obliquely illustrates an enlarged view of a part of the conveyance unit of the image forming apparatus according to the one embodiment.
Figure 13:
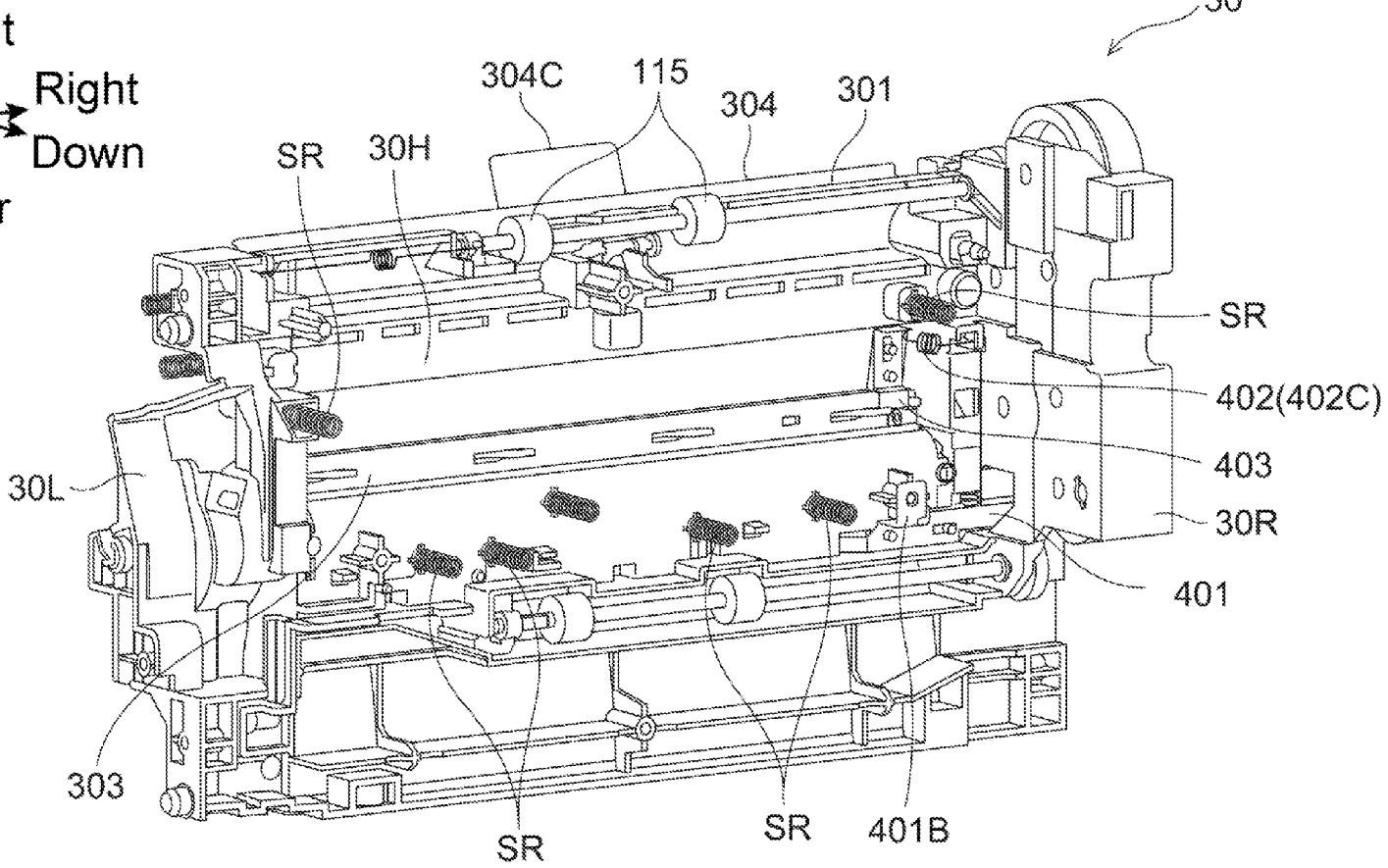
FIG. 13 illustrates the conveyance unit of the image forming apparatus according to the one embodiment obliquely from a lower side.
Figure 14:
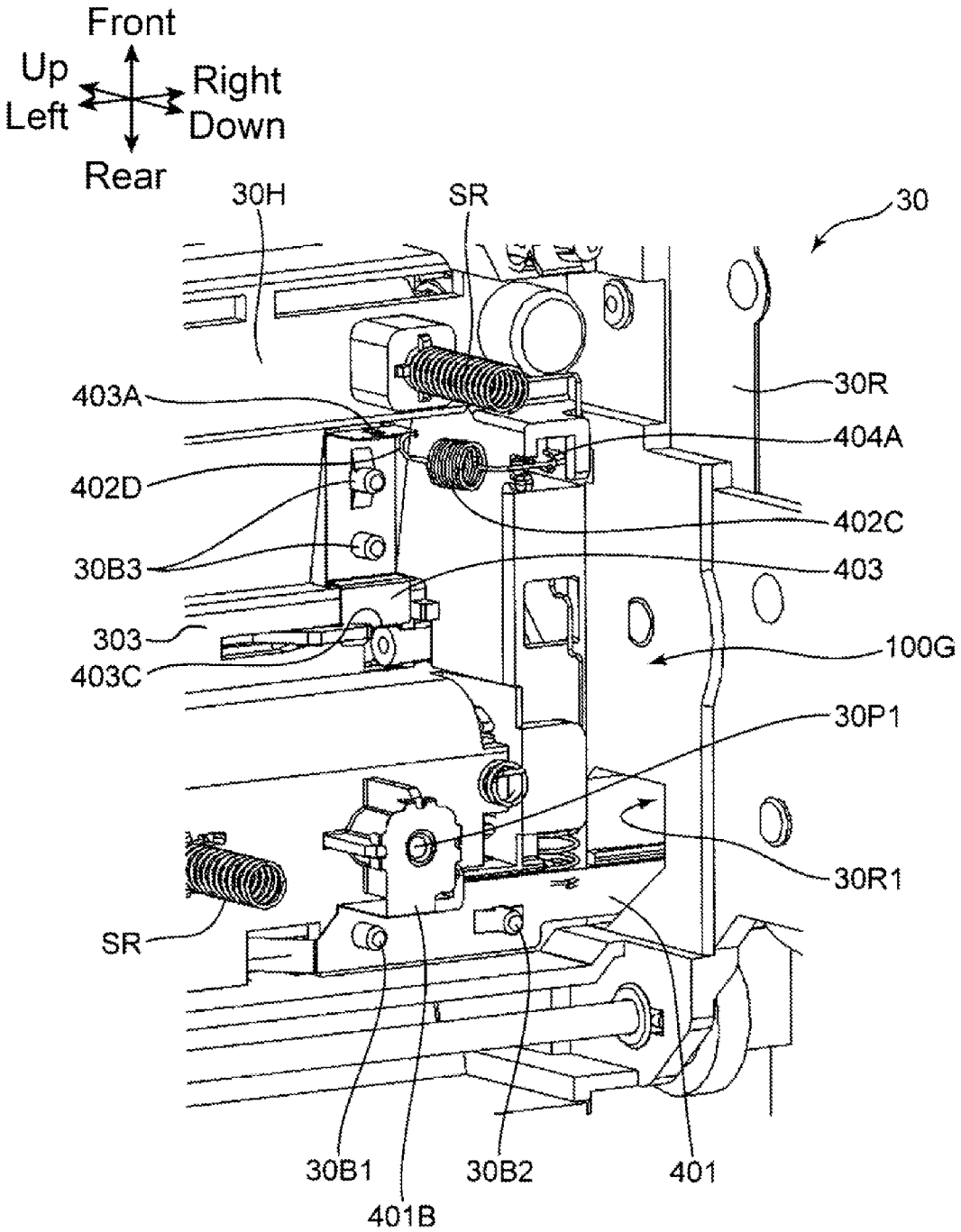
FIG. 14 obliquely illustrates an enlarged view of a part of the conveyance unit in FIG. 13.

FIG. 11 obliquely illustrates the enlarged view of the one end portion of the conveyance unit 30 according to the embodiment. FIG. 12A obliquely illustrates the enlarged view of the right side frame 200R and a part of the conveyance unit 30 of the printer 100 according to the embodiment. FIG. 12B obliquely illustrates the enlarged view of a part of the conveyance unit 30. FIG. 12B corresponds to a state where an illustration of the right side frame 200R is omitted in FIG. 12A. FIG. 13 illustrates the conveyance unit 30 obliquely from the lower side. FIG. 14 obliquely illustrates the enlarged view of a part of the conveyance unit 30 in FIG. 13. FIGS. 15 to 21 obliquely illustrate a part of a grounding conductive mechanism 100G of the printer 100 according to the embodiment, respectively.

Figure 15:
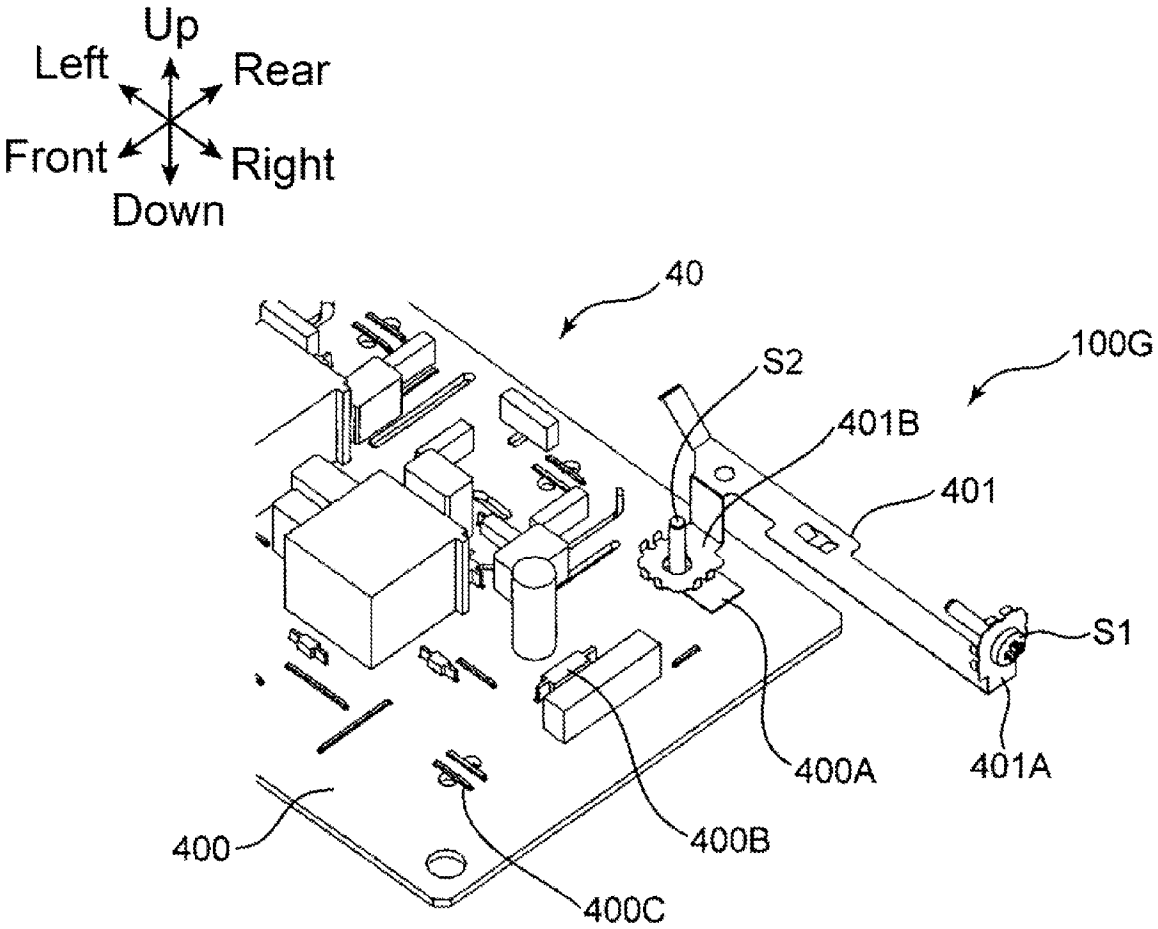
FIG. 15 obliquely illustrates a part of a grounding conductive mechanism of the image forming apparatus according to the one embodiment.

The printer 100 includes a high voltage board 40 (an electric board) and the grounding conductive mechanism 100G (FIG. 15). The high voltage board 40 is located inside the conveyance unit 30 in the housing 200. The high voltage board 40 includes a plurality of electric components. The high voltage board 40 is an electric board that supplies a high voltage to a plurality of members inside the printer 100. With reference to FIG. 15, the high voltage board 40 includes a plate unit 400, a first conduction terminal 400A, a resistor 400B, and a second conduction terminal 400C. The plate unit 400 is a main unit of the high voltage board 40. The first conduction terminal 400A is a metallic terminal part exposed in the rear end and right end portion of the top surface portion of the plate unit 400. The resistor 400B is a resistor component included on the top surface portion of the plate unit 400. The resistor 400B is a high-resistance resistor having a predetermined electrical resistance. The second conduction terminal 400C is a metallic terminal part exposed in the front end and the right end portion of the top surface portion of the plate unit 400. The rear-end-side terminal of the resistor 400B is electrically conducted with the first conduction terminal 400A, inside the plate unit 400. The front-end-side terminal of the resistor 400B is electrically conducted with the second conduction terminal 400C, inside the plate unit 400. Consequently, the first conduction terminal 400A and the second conduction terminal 400C are electrically connected via the resistor 400B.

The grounding conductive mechanism 100G is an electrical conductive path formed in the right side frame 200R and the conveyance unit 30 inside the printer 100. In this embodiment, the grounding conductive mechanism 100G electrically conducts the registration roller 116A, the pre-registration sheet metal 304, the post-registration sheet metal 305, and the pre-transfer guide 303 with the right side frame 200R via the resistor 400B of the high voltage board 40. Consequently, the registration roller 116A, the pre-registration sheet metal 304, the post-registration sheet metal 305, and the pre-transfer guide 303 are grounded with the common conductive path.

The grounding conductive mechanism 100G includes a first conduction sheet metal 401 (FIG. 15) (a first conduction portion), a first conduction spring 402 (FIG. 16) (a second conduction portion), a second conduction sheet metal 403 (FIG. 17) (a third conduction portion), and a second conduction spring 404 (FIG. 18) (the third conduction portion). The first conduction sheet metal 401 is a metallic plate-shaped member that extends in the lateral direction. The first conduction sheet metal 401 includes a first-sheet-metal fastening portion 401A located in one end side in the longitudinal direction and a first-sheet-metal conduction portion 401B located in the other end side in the longitudinal direction.

With reference to FIGS. 7 and 11, the conveyance unit 30 is secured to the right side frame 200R with a plurality of screws including the first screw S1. Further, with reference to FIGS. 12A and 12B, the conveyance unit 30 includes a unit supporting portion 30R1 that is constituted of a part of the unit-right-side wall 30R. The unit supporting portion 30R1 has a pipe structure with an approximately trapezoidal shape in a cross-sectional view. Securing the conveyance unit 30 to the right side frame 200R arranges the unit supporting portion 30R1 to face to the frame opening 200RH of the right side frame 200R (FIG. 12A). When the right side frame 200R and the unit-right-side wall 30R are secured with the first screw S1, the first-sheet-metal fastening portion 401A of the first conduction sheet metal 401 is secured between the right side frame 200R and the unit-right-side wall 30R. On the other hand, when the high voltage board 40 is mounted to the conveyance unit 30, the first-sheet-metal conduction portion 401B of the first conduction sheet metal 401 is brought into contact with the first conduction terminal 400A of the plate unit 400 (FIG. 15). Consequently, the right side frame 200R and the first conduction terminal 400A of the high voltage board 40 are electrically conducted via the first conduction sheet metal 401. Thus, the first conduction sheet metal 401 has a function of grounding the high voltage board 40.

With reference to FIG. 13, the conveyance unit 30 includes a unit top panel portion 30H in addition to the above-described unit-right-side wall 30R and unit-left-side wall 30L. The unit top panel portion 30H is a plate-shaped member extending in the front-rear and lateral directions. The unit-right-side wall 30R, the unit-left-side wall 30L, and the unit top panel portion 30H are constituted of an integrated member made of resin and function as a housing supporting the respective members of the conveyance unit 30. In the inferior surface portion of the unit top panel portion 30H in FIG. 13, a plurality of board pressing springs SR are located in the rear with respect to the conveyance roller 115. The plurality of board pressing springs SR are located such that they draw an approximately U shape. The above-described high voltage board 40 is mounted to the conveyance unit 30 such that the surface with the electric components faces upward, that is, the plurality of electric components are located facing the unit top panel portion 30H. In this case, the plurality of board pressing springs SR are brought into contact with the plate unit 400 of the high voltage board 40. Then, the high voltage board 40 is secured to the conveyance unit 30 with screws (not illustrated). In this case, the first conduction terminal 400A, the resistor 400B, and the second conduction terminal 400C of the high voltage board 40 are located inside the unit-right-side wall 30R in FIG. 13.

With reference to FIG. 14, the left end side of the first conduction sheet metal 401, which extends from the unit supporting portion 30R1 to the inside of the conveyance unit 30, is positioned with bosses 30B1 and 30B2 located projecting from the unit top panel portion 30H. Then, the hole portion formed in the first-sheet-metal conduction portion 401B of the first conduction sheet metal 401 is located facing to a screw hole 30P1 opened in the unit top panel portion 30H. A second screw S2 illustrated in FIG. 15 passes through a hole portion (not illustrated) opened in the plate unit 400 of the high voltage board 40 and the hole portion of the first-sheet-metal conduction portion 401B, and is fastened to the screw hole 30P1.

With reference to FIG. 15, electrically conducting the first-sheet-metal conduction portion 401B of the first conduction sheet metal 401 with the first conduction terminal 400A of the high voltage board 40 enables the second conduction terminal 400C of the high voltage board 40 to be grounded. In the grounding conductive mechanism 100G according to the embodiment, electrically connecting the registration roller pair 116, the pre-registration sheet metal 304, the post-registration sheet metal 305, and the pre-transfer guide 303 to this second conduction terminal 400C ensures grounding of the respective members.

Figure 16:
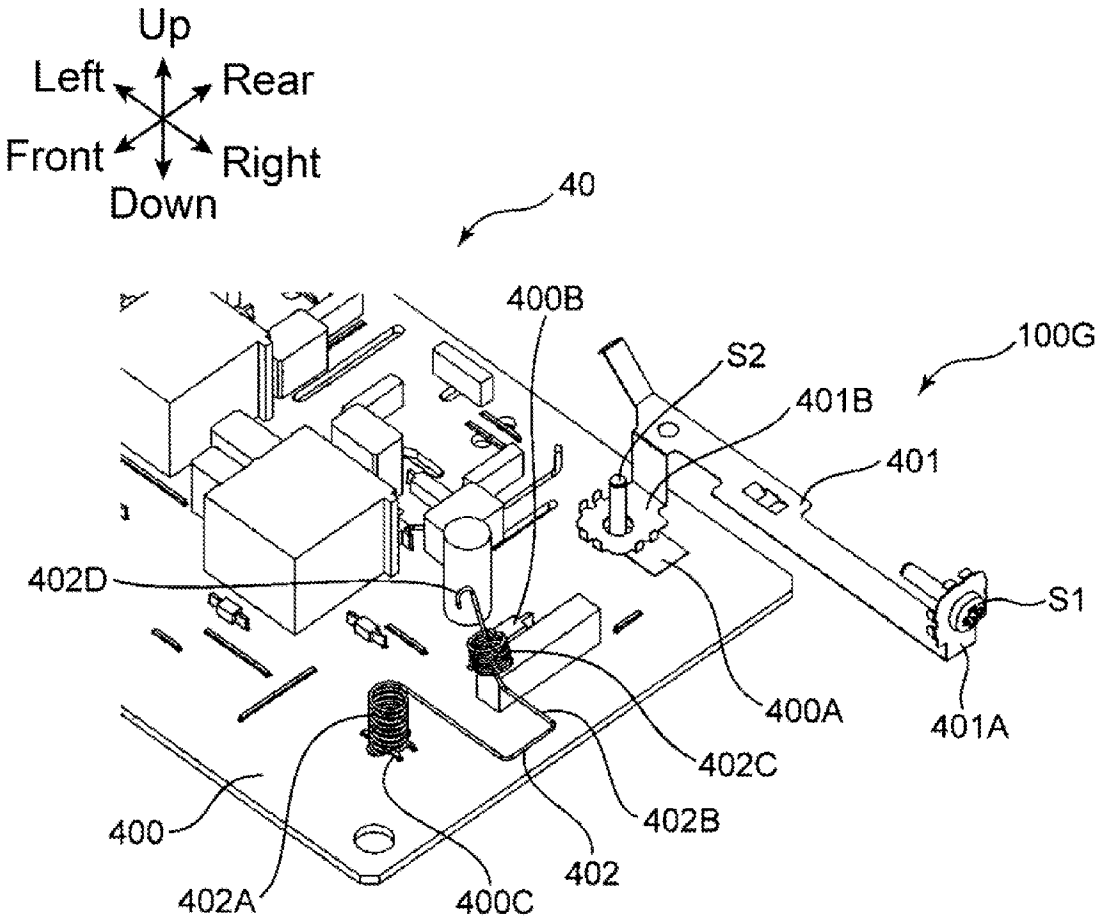
FIG. 16 obliquely illustrates a part of the grounding conductive mechanism of the image forming apparatus according to the one embodiment.

With reference to FIG. 16, the first conduction spring 402 is a spring member having two coil portions. The first conduction spring 402 includes a first coil portion 402A, a connecting portion 402B, a second coil portion 402C, and a first engaging portion 402D. The first coil portion 402A is in contact with the second conduction terminal 400C. The connecting portion 402B is a U-shaped conductive wire portion connecting the first coil portion 402A to the second coil portion 402C. The first engaging portion 402D extends upward from the second coil portion 402C and has a hook shape. In FIG. 14, an illustration of the first coil portion 402A is omitted, and only the second coil portion 402C and the first engaging portion 402D are illustrated. The first engaging portion 402D is engagingly locked to a first engaged portion 403A, which will be described below.

Figure 17:
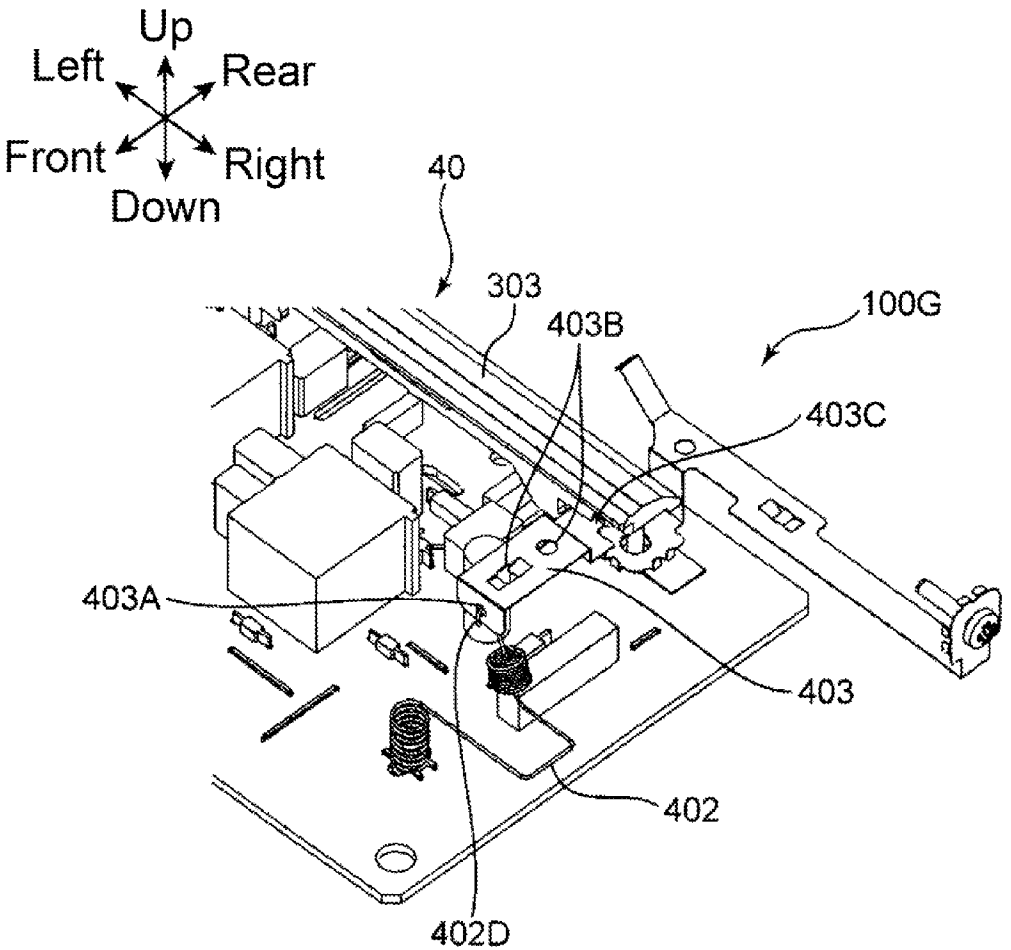
FIG. 17 obliquely illustrates a part of the grounding conductive mechanism of the image forming apparatus according to the one embodiment.

With reference to FIG. 17, the second conduction sheet metal 403 is a metallic plate-shaped member located over the plate unit 400 of the high voltage board 40 (FIG. 14). The second conduction sheet metal 403 includes the first engaged portion 403A, a boss hole 403B, and a second-sheet-metal securing portion 403C. The first engaging portion 402D of the above-described first conduction spring 402 is engagingly locked in the hole portion opened in the first engaged portion 403A. This results in electrically conducting the first conduction spring 402 with the second conduction sheet metal 403. A boss 30B3 (FIG. 14) located projecting from the unit top panel portion 30H is inserted into the boss hole 403B. Consequently, the unit top panel portion 30H supports the second conduction sheet metal 403. With reference to FIGS. 14 and 17, the second-sheet-metal securing portion 403C of the second conduction sheet metal 403 is brought into contact with the right end portion of the pre-transfer guide 303. Consequently, the second conduction sheet metal 403 and the pre-transfer guide 303 are electrically conducted.

Figure 18:
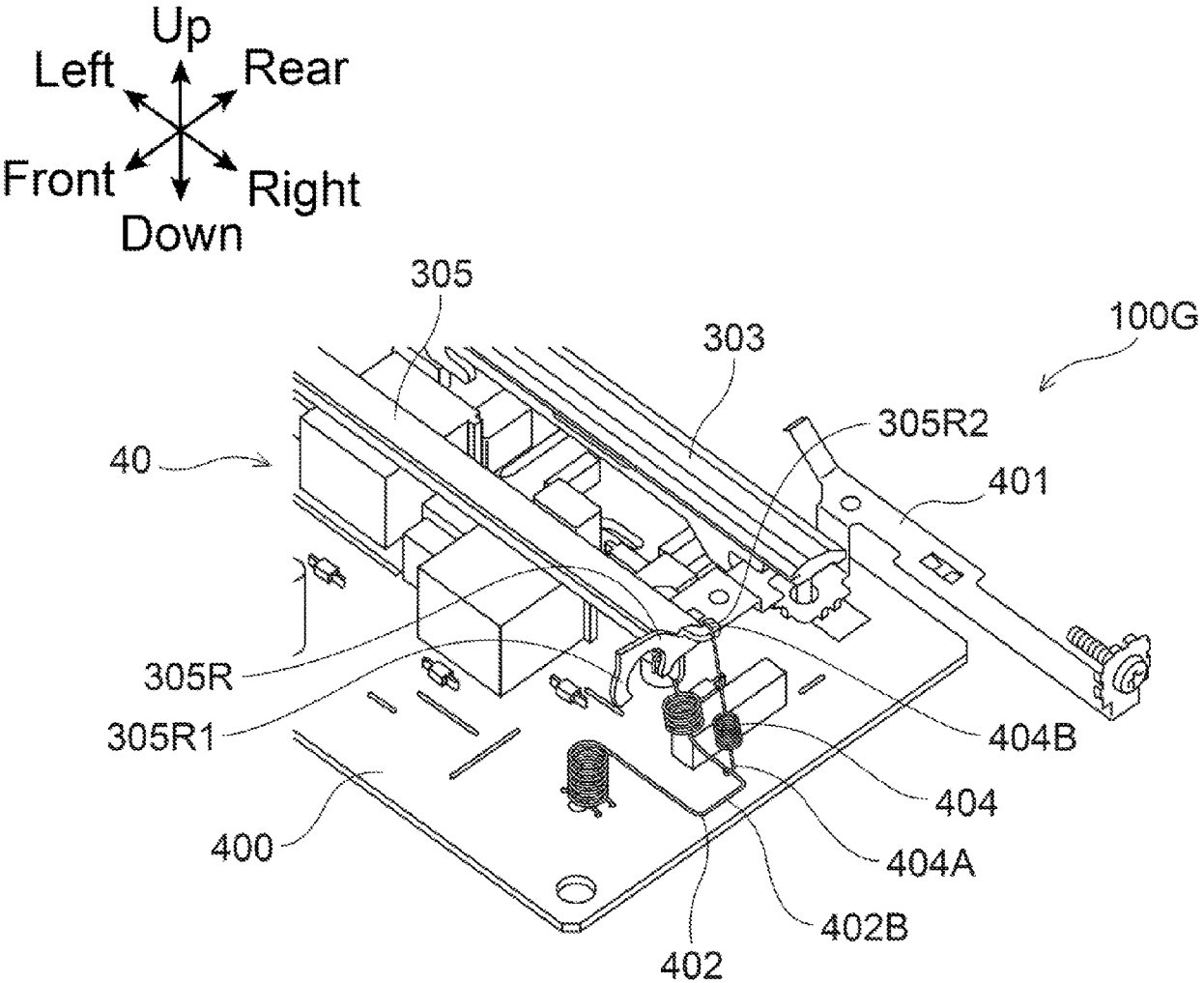
FIG. 18 obliquely illustrates a part of the grounding conductive mechanism of the image forming apparatus according to the one embodiment.

With reference to FIG. 18, the second conduction spring 404 is a coil spring extending in the vertical direction. The second conduction spring 404 includes a second engaging portion 404A and a third engaging portion 404B. The second conduction spring 404 causes the post-registration sheet metal 305 and the first conduction spring 402 to be conducted. The post-registration sheet metal 305 includes a post-registration-sheet-metal sidewall 305R. The post-registration-sheet-metal sidewalls 305R are sidewalls located in the left end and right end portions of the post-registration sheet metal 305, respectively. The post-registration-sheet-metal sidewall 305R includes a sidewall supporting portion 305R1 and a sidewall engaged portion 305R2. The sidewall supporting portion 305R1 has a U shape having an opening in the lower portion. The sidewall engaged portion 305R2 is a lock portion formed in the rear end side of the post-registration-sheet-metal sidewall 305R. The second engaging portion 404A of the second conduction spring 404 is engagingly locked to the connecting portion 402B of the first conduction spring 402 (FIGS. 14 and 18). On the other hand, the third engaging portion 404B of the second conduction spring 404 is engagingly locked to the sidewall engaged portion 305R2 of the post-registration sheet metal 305. Consequently, the second conduction spring 404 electrically conducts the post-registration sheet metal 305 to the first conduction spring 402, thus grounding the post-registration sheet metal 305. In this case, the post-registration sheet metal 305 and the first conduction spring 402 are stably electrically conducted by an elastic force of the second conduction spring 404.

Figure 19:
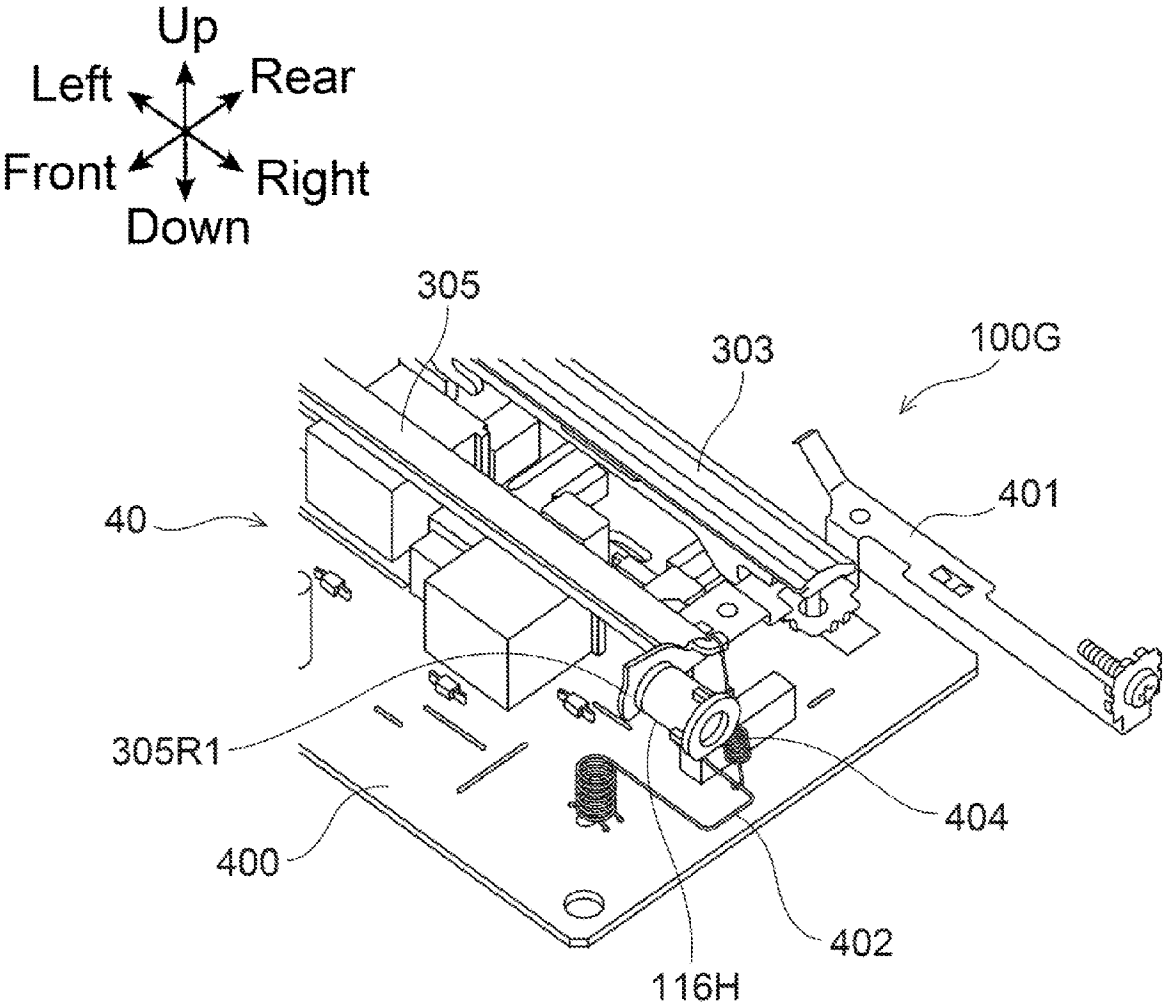
FIG. 19 obliquely illustrates a part of the grounding conductive mechanism of the image forming apparatus according to the one embodiment.
Figure 20:
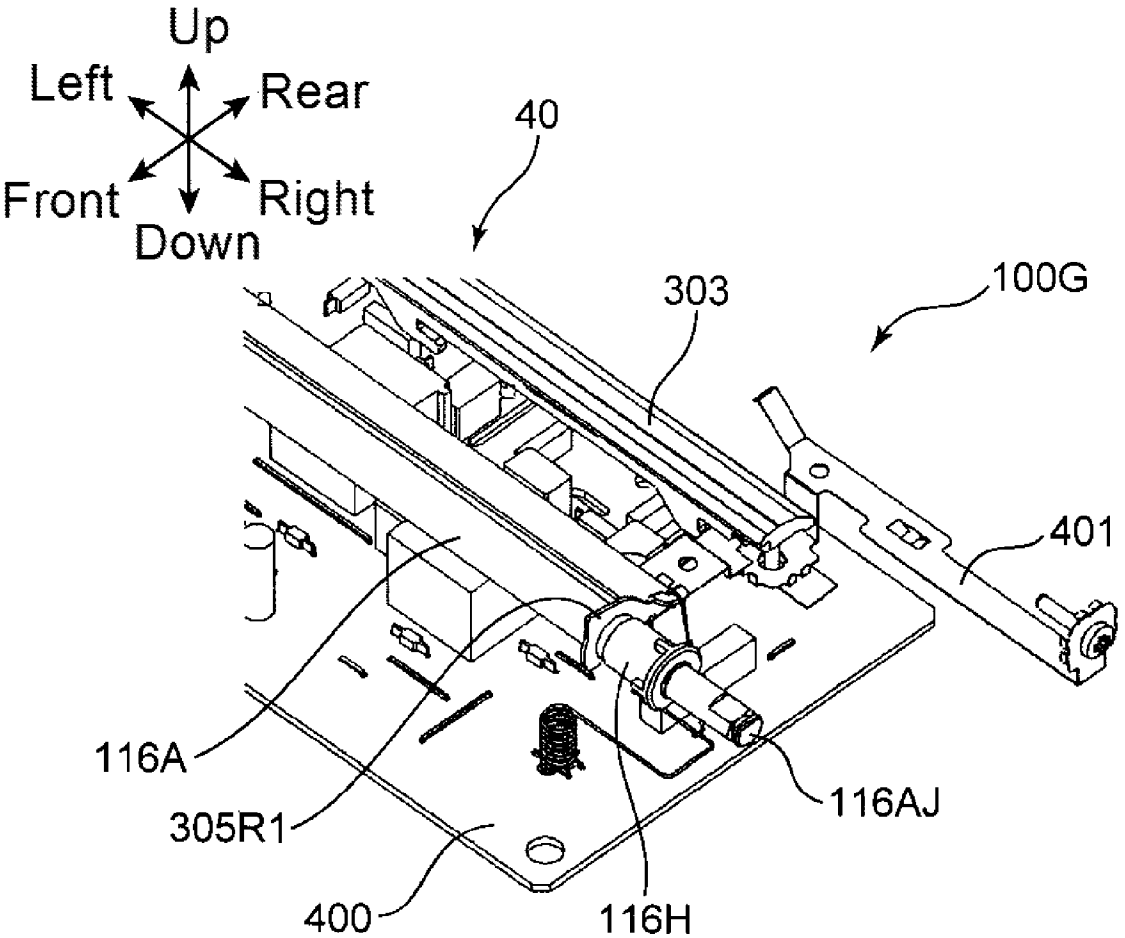
FIG. 20 obliquely illustrates a part of the grounding conductive mechanism of the image forming apparatus according to the one embodiment.

With reference to FIGS. 19 and 20, the registration-roller bearing portion 116H, which pivotally supports the registration roller pair 116, is inserted into the sidewall supporting portion 305R1 of the post-registration sheet metal 305. Consequently, the position of the post-registration sheet metal 305 is defined based on the registration-roller shaft portion 116AJ of the registration roller 116A. Although only the right end side of the registration roller 116A is illustrated in FIG. 19, the left end side of the registration roller 116A has also the bearing configuration identical to FIG. 19. The registration roller 116A is electrically conducted with the first conduction spring 402 via the registration-roller bearing portion 116H, the post-registration sheet metal 305, and the second conduction spring 404 because the registration-roller bearing portion 116H is made of a conductive resin material. Consequently, the registration roller 116A is grounded.

Figure 21:
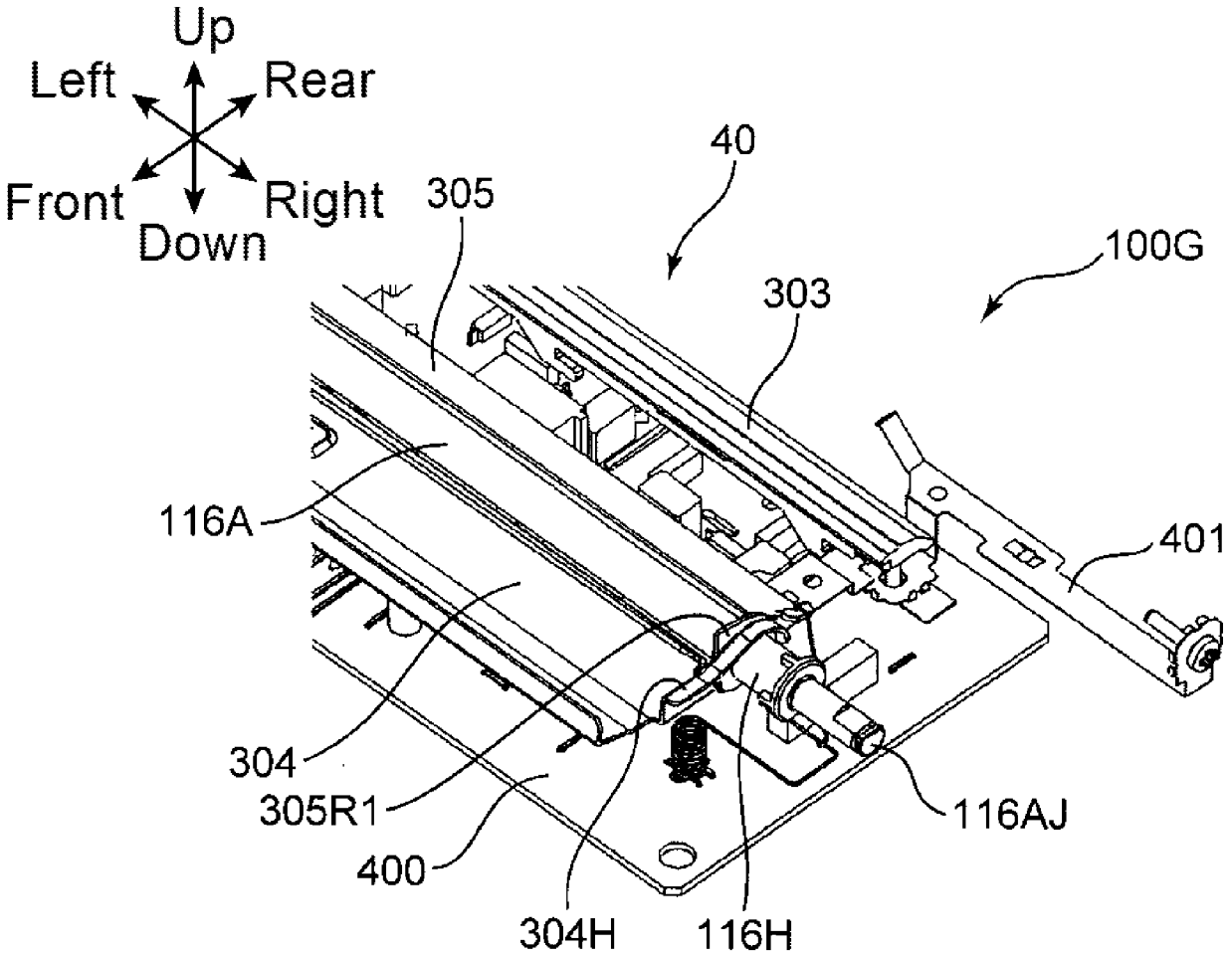
FIG. 21 obliquely illustrates a part of the grounding conductive mechanism of the image forming apparatus according to the one embodiment.

With reference to FIG. 21, the rear end portion of the sheet-metal handle portion 304H of the pre-registration sheet metal 304 is fit onto the registration-roller bearing portion 116H so as to be adjacent to the sidewall supporting portion 305R1. Thus, the pre-registration sheet metal 304 is electrically conducted with the first conduction spring 402 via the registration-roller bearing portion 116H, the post-registration sheet metal 305, and the second conduction spring 404. Consequently, the pre-registration sheet metal 304 is grounded.

In this embodiment, the first conduction sheet metal 401 constitutes the first conduction portion of the disclosure, and the first conduction spring 402 constitutes the second conduction portion of the disclosure. Further, the second conduction sheet metal 403, the second conduction spring 404, and the registration-roller bearing portion 116H constitute the third conduction portion of the disclosure. With this configuration, securing the conveyance unit 30 to the right side frame 200R can easily ground the registration roller 116A, the pre-transfer guide 303, the pre-registration sheet metal 304, and the post-registration sheet metal 305.

As described above, in this embodiment, the grounding conductive mechanism 100G causes the registration roller 116A, the pre-transfer guide 303, the pre-registration sheet metal 304, and the post-registration sheet metal 305 to be electrically conducted with the right side frame 200R via the single resistor 400B. In view of this, the sheet conveyance path SP (FIG. 4) leading from the registration roller pair 116 up to the transfer nip portion TP is grounded via the identical resistor 400B. Consequently, even when the toner image is transferred from the photoreceptor drum 121 to the sheet S in a state where the conveyed sheet S spans the region from the registration roller pair 116 to the transfer nip portion TP, this prevents the electric charge of the sheet S from becoming unstable. This ensures stable transfer of the toner image to the sheet S.

Although the printer 100 (image forming apparatus) according to the embodiment of the disclosure has been described above, the disclosure will not be limited to the embodiment, and, for example, the following modified embodiments can be employed.

(1) Although the above-described embodiment has described the aspect where the high voltage board 40 includes the resistor 400B, the disclosure will not be limited to this aspect. Other electric board or part of the housing 200 may include the resistor 400B.

(2) The above-described embodiment has described the aspect where a user clasps the sheet-metal handle portion 304H when rotating the pre-registration sheet metal 304 with the registration-roller bearing portion 116H as the fulcrum, the disclosure will not be limited to this aspect. As illustrated in FIG. 13, the following aspect may be employed; the pre-registration sheet metal 304 includes a center handle portion 304C in the center in the lateral direction of the pre-registration sheet metal 304, and a user clasps the center handle portion 304C.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

a housing made of metal and having a grounded inner wall;

a paper sheet feeder that feeds a sheet;

a sheet conveyance path that conveys the sheet fed from the paper sheet feeder in a predetermined conveyance direction;

an image carrier that carries a developer image on a surface of the image carrier;

a transfer member located facing the image carrier, the transfer member forming a transfer nip portion through which the sheet passes between the image carrier and the transfer member, so as to transfer the developer image onto the sheet;

a registration roller pair located between the paper sheet feeder and the transfer member in the sheet conveyance path, the registration roller pair including a metallic registration roller and a facing roller, constituted of an elastic material, rotating in abutting contact with the registration roller, the registration roller pair conveying the sheet toward the transfer nip portion;

a first guiding portion disposed in the sheet conveyance path at least either upstream or downstream of the registration roller pair in the conveyance direction, the first guiding portion being made of metal and guiding the sheet;

a second guiding portion made of a conductive resin material, the second guiding portion guiding the sheet conveyed by the registration roller pair toward the transfer nip portion;

a resistor with a predetermined electrical resistance;

a grounding conductive mechanism that electrically conducts the registration roller, the first guiding portion, and the second guiding portion to the inner wall via the resistor;

a conveyance unit constituting a part of the sheet conveyance path, the conveyance unit supporting the registration roller pair, the first guiding portion, and the second guiding portion, and being secured to the housing;

an electric board disposed in the conveyance unit and including a plurality of electric components, for supplying high voltage to a plurality of image-forming-apparatus internal components; wherein the resistor is disposed on the electric board, and the grounding conductive mechanism is distributively arranged from the registration roller pair, the first guiding portion, and the second guiding portion to the inner wall via the electric board.

2. The image forming apparatus according to claim 1, wherein:

the sheet conveyance path runs along an approximately horizontal direction from the upstream side in the conveyance direction up to the downstream side in the conveyance direction of the registration roller pair;

the first guiding portion includes an upstream-side guiding member defining a top surface portion of the sheet conveyance path in the upstream side in the conveyance direction with respect to the registration roller pair; and the upstream-side guiding member turns around a fulcrum located coaxially on a rotation shaft of the registration roller to ensure opening a part of the sheet conveyance path.

3. The image forming apparatus according to claim 1, wherein:

the first guiding portion includes a downstream-side guiding member defining a top surface portion of the sheet conveyance path in the downstream side in the conveyance direction with respect to the registration roller pair; and the image forming apparatus further comprises an image forming unit having a bottom surface portion located over the downstream-side guiding member at interval, rotatably supporting the image carrier, and being removably attachable to the housing.

4. The image forming apparatus according to claim 3, wherein the bottom surface portion of the image forming unit defines the top surface portion of the sheet conveyance path in the downstream side in the conveyance direction with respect to the downstream-side guiding member, and guides the sheet toward the transfer nip portion.

5. The image forming apparatus according to claim 1, wherein the grounding conductive mechanism includes:

a first conduction portion electrically conducts the inner wall to the electric board, a second conduction portion connected to the electric board and electrically conducted with the first conduction portion in the electric board via the resistor, and a third conduction portion electrically conducts the second conduction portion to the registration roller, the first guiding portion, and the second guiding portion.

* * * * *